US009536472B2

(12) United States Patent
Park et al.

(10) Patent No.: US 9,536,472 B2
(45) Date of Patent: Jan. 3, 2017

(54) DISPLAY DEVICE AND REPAIRING METHOD THEREOF

(71) Applicant: SAMSUNG DISPLAY CO., LTD., Yongin, Gyeonggi-Do (KR)

(72) Inventors: Kyong Tae Park, Suwon-si (KR); Yu-Hyun Cho, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 7 days.

(21) Appl. No.: 14/745,194

(22) Filed: Jun. 19, 2015

(65) Prior Publication Data

US 2016/0217735 A1 Jul. 28, 2016

(30) Foreign Application Priority Data

Jan. 27, 2015 (KR) ..... 10-2015-0013043

(51) Int. Cl.
*G09G 3/3233* (2016.01)
*G09G 3/32* (2016.01)
*G09G 3/20* (2006.01)

(52) U.S. Cl.
CPC ..... *G09G 3/3233* (2013.01); *G09G 3/2003* (2013.01); *G09G 2300/0413* (2013.01); *G09G 2300/0426* (2013.01); *G09G 2300/0876* (2013.01)

(58) Field of Classification Search
CPC .... G09G 3/3233; G09G 3/2003; G09G 3/006; G09G 3/3225; G09G 3/3291
USPC ..... 345/212
See application file for complete search history.

(56) References Cited

U.S. PATENT DOCUMENTS 9,018,947 B2 * 4/2015 Jin ..... G01R 31/2635 324/244
9,093,023 B1 * 7/2015 Kim ..... H01L 27/3223
2007/0152567 A1 * 7/2007 Yao ..... G09G 3/3233 313/504
2012/0306939 A1 * 12/2012 Choi ..... G09G 3/006 345/690
2014/0329339 A1 * 11/2014 Chaji ..... G01R 31/26 438/10
2014/0374730 A1 * 12/2014 Sato ..... G09G 3/3233 257/40

(Continued)

FOREIGN PATENT DOCUMENTS

KR 10-0666639 B1 1/2007
KR 10-2012-0002070 A 1/2012
KR 10-2012-0009904 2/2012

*Primary Examiner* — Fred Tzeng
(74) *Attorney, Agent, or Firm* — Lewis Roca Rothgerber Christie LLP

(57) ABSTRACT

An organic light emitting device having a repair line connected to an organic light emitting element of a bad pixel. A first capacitor stores a voltage corresponding to a data voltage of the bad pixel, and a driving transistor outputs a current corresponding to the voltage stored in the first capacitor to an output terminal. A first transistor is connected between the output terminal of the driving transistor and the repair line, and is turned on or turned off in response to a first signal. A second transistor is connected between the repair line and a node, and is configured to be turned on or turned off in response to a second signal. A third transistor is connected between a node and a first voltage line for supplying a first voltage, and is turned on or turned off in response to a third signal.

20 Claims, 22 Drawing Sheets

(56) References Cited

U.S. PATENT DOCUMENTS

| | | | | |
|---|---|---|---|---|
| 2015/0109189 | A1* | 4/2015 | Hwang | G09G 3/3225 345/78 |
| 2015/0294618 | A1* | 10/2015 | Park | G09G 3/3291 345/214 |
| 2016/0140897 | A1* | 5/2016 | Park | G09G 3/3225 345/77 |

* cited by examiner

DISPLAY DEVICE AND REPAIRING METHOD THEREOF

CROSS-REFERENCE TO RELATED APPLICATION

This application claims priority to and the benefit of Korean Patent Application No. 10-2015-0013043 filed in the Korean Intellectual Property Office on Jan. 27, 2015, the entire contents of which are incorporated herein by reference.

BACKGROUND

1. Field

The described technology relates generally to a display device and a repairing method thereof.

2. Description of the Related Art

An organic light emitting diode (OLED) display is a self-light emitting display device that does not require a separate light source. As such, it has low power consumption and excellent response speed, viewing angle, and contrast ratio.

The organic light emitting diode (OLED) display includes a plurality of pixels such as red pixels, blue pixels, green pixels, and white pixels, and may express full colors by combining the pixels. Each pixel includes a light emitting element, and a plurality of thin film transistors for driving the light emitting element.

The light emitting element of the organic light emitting diode (OLED) display includes a pixel electrode, a common electrode, and an emission layer positioned between the two electrodes. One of the pixel electrode and the common electrode is an anode and the other is a cathode. Electrons injected from the cathode and holes injected from the anode combine with each other in the light emitting layer to form excitons, and the excitons emit light while discharging energy. The common electrode is formed throughout a plurality of pixels to transmit a predetermined common voltage.

The organic light emitting device may be produced with a bad pixel during a manufacturing process because of complexity of a pixel circuit and difficulty in the manufacturing process. Therefore, a repairing process for using the bad pixel that is created during the manufacturing process as a normal pixel is desirable so as to increase the yield.

SUMMARY

Embodiments provide a display device for repairing a bad pixel as a normal pixel and a repairing method thereof.

An embodiment provides an organic light emitting device including a repair line connected to an organic light emitting element of a bad pixel, a first capacitor, a second capacitor, a driving transistor, a first transistor, a second transistor, and a third transistor. The first capacitor stores a voltage corresponding to a data voltage of the bad pixel. The driving transistor outputs a current corresponding to the voltage stored in the first capacitor to an output terminal. The first transistor is connected between the output terminal of the driving transistor and the repair line, and is configured to be turned on or turned off in response to a first signal. The second transistor is connected between the repair line and a node, and is turned on or turned off in response to a second signal. The third transistor is connected between the node and a first voltage line for supplying a first voltage, and is turned on or turned off in response to a third signal. The second capacitor is connected between the node and a second voltage line for supplying a second voltage.

While the first transistor and the second transistor are turned off, a voltage of the third signal may be changed from a first level to a second level to turn on the third transistor.

After the voltage of the third signal is changed to the first level from the second level to turn off the third transistor, the first transistor and the second transistor may be turned on.

The first signal may be the same as the second signal.

While the first transistor is turned off and the second transistor is turned on, the voltage of the third signal may be changed to a second level from a first level to turn on the third transistor.

After the second transistor is turned off, the voltage of the third signal may be changed to the first level from the second level to turn off the third transistor.

When the third transistor is turned off, the first transistor and the second transistor may be turned on.

The first voltage may be the same as the second voltage.

The second voltage may be the same as a driving voltage transmitted to the driving transistor.

The third signal may be an inverted signal of the second signal.

The organic light emitting device may further include a fourth transistor configured to transmit the data voltage when turned on in response to a scan signal. The third signal may be the same as the scan signal.

The organic light emitting device may further include a fourth transistor configured to be turned on in response to a fourth signal to initialize a voltage of the capacitor with an initialization voltage. The first voltage may be the same as the initialization voltage.

The third signal may be the same as the fourth signal.

Another embodiment provides an organic light emitting device including a repair line connected to an organic light emitting element of a bad pixel and a dummy pixel connected to the repair line. The dummy pixel includes a dummy pixel driving circuit configured to output a driving current corresponding to a data voltage of the bad pixel to the repair line in response to a first signal, and a capacitor. The capacitor is initialized before the driving current is output by the dummy pixel driving circuit, and is charged by the driving current and performs a charge sharing with a parasitic capacitance component of the repair line when the dummy pixel driving circuit outputs the driving current.

The dummy pixel may further include a transistor connected between the capacitor and the repair line, and the transistor may be turned on or turned off in response to the first signal.

The dummy pixel may further include a transistor connected between the capacitor and a voltage line for supplying an initialization voltage, and the transistor may be turned on or turned off in response to a second signal.

Before the dummy pixel driving circuit outputs the driving current to the repair line, the voltage of the second signal may be changed to a second level from a first level to turn on the transistor.

After the voltage of the second signal is changed to the first level from the second level to turn on the transistor, the dummy pixel driving circuit may output the driving current to the repair line.

Yet another embodiment provides a method of repair an organic light emitting device. The method includes connecting a repair line to an organic light emitting element of a bad pixel, initializing a capacitor, outputting a driving current corresponding to a data voltage of the bad pixel to the repair line, while outputting the driving current to the repair line, charging the capacitor with the driving current, and while outputting the driving current to the repair line, performing a charge sharing between the capacitor and a parasitic capacitance component of the repair line.

The method may further include allowing the organic light emitting element of the bad pixel to emit light with the driving current.

DETAILED DESCRIPTION

Figure 1:
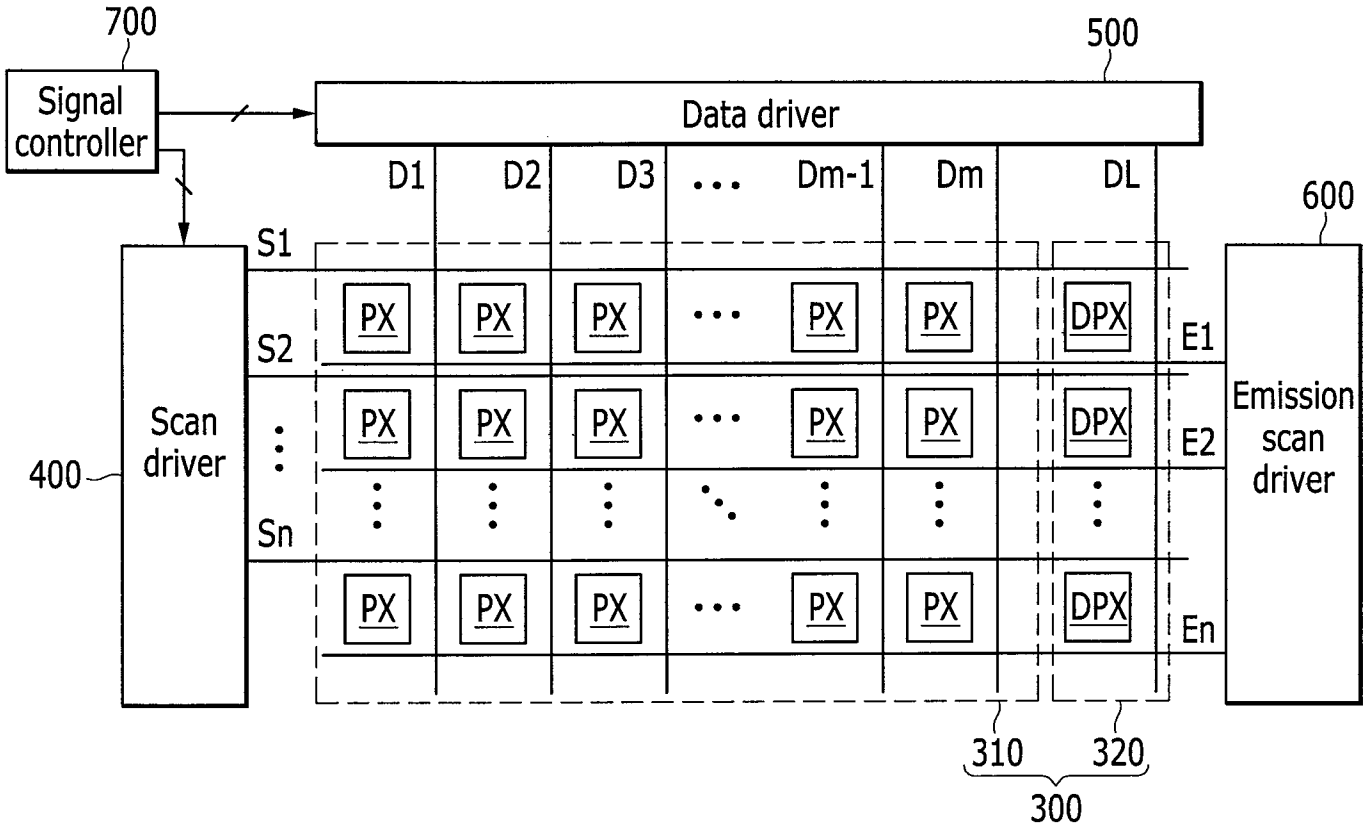
FIG. 1 shows a block diagram of an organic light emitting device according to an embodiment.

In the following detailed description, only certain embodiments have been shown and described, simply by way of illustration. As those skilled in the art would realize, the described embodiments may be modified in various suitable different ways, all without departing from the spirit or scope of the present invention. Accordingly, the drawings and description are to be regarded as illustrative in nature and not restrictive. Like reference numerals designate like elements (or components) throughout the specification.

It will be understood that, although the terms "first", "second", "third", etc., may be used herein to describe various elements, components, regions, layers, and/or sections, these elements, components, regions, layers and/or sections should not be limited by these terms. These terms are only used to distinguish one element, component, region, layer or section from another element, component, region, layer or section. Thus, a first element, component, region, layer, or section discussed below could be termed a second element, component, region, layer, or section, without departing from the spirit and scope of the present invention.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "include," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

A person of skill in the art should also recognize that the process may be executed via hardware, firmware (e.g. via an ASIC), or in any combination of software, firmware, and/or hardware. Furthermore, the sequence of steps of the process is not fixed, but can be altered into any desired sequence as recognized by a person of skill in the art. The altered sequence may include all of the steps or a portion of the steps.

The display and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display may be formed on one integrated circuit (IC) chip or on separate IC chips. Further, the various components of the display may be implemented on a flexible printed circuit film, a tape carrier package (TCP), a printed circuit board (PCB), or formed on a same substrate as one or more circuits and/or devices. Further, the various components of the display may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Figure 2:
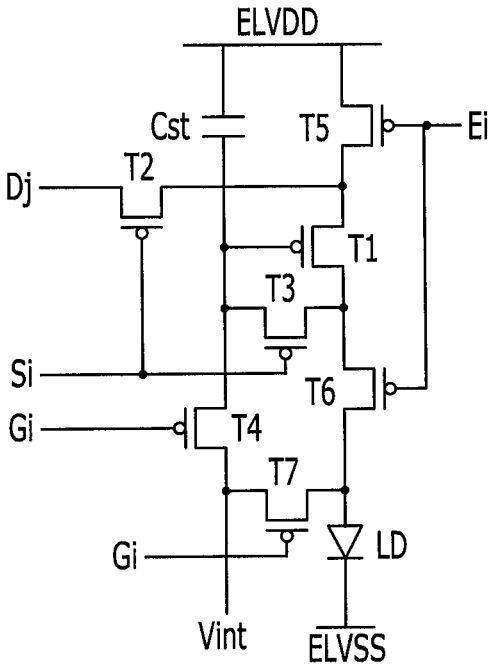
FIG. 2 shows an equivalent circuit diagram of a pixel of an organic light emitting device according to an embodiment.

FIG. 1 shows a block diagram of an organic light emitting device according to an embodiment, and FIG. 2 shows an equivalent circuit diagram of a pixel of an organic light emitting device according to an embodiment.

Referring to FIG. 1, the organic light emitting device includes a display panel 300, a scan driver 400, a data driver 500, an emission scan driver 600, and a signal controller 700.

Referring to FIG. 1, the display panel 300 includes a display area 310 and a dummy region 320. The display area 310 includes a plurality of signal lines S1-Sn, E1-En, and D1-Dm and a plurality of pixels PX connected thereto and arranged substantially in a matrix form. The dummy region 320 includes a dummy signal line DL and a plurality of dummy pixel DPX connected thereto.

The signal lines S1-Sn, E1-En, and D1-Dm include a plurality of scan lines S1-Sn for transmitting a scan signal, a plurality of data lines D1-Dm for transmitting a data signal according to an input image signal, and a plurality of emission scan lines E1-En for transmitting emission scan signals En for controlling emission of light. The scan lines S1-Sn extend substantially in a row direction and are substantially parallel with each other, the data lines D1-Dm extend substantially in a column direction and are substantially parallel with each other, and the emission scan lines E1-En extend substantially in the row direction and are substantially parallel with each other. A plurality of pixels PX are respectively formed in regions defined by the scan lines S1-Sn and the data lines D1-Dm.

The dummy signal line DL transmits the data signal corresponding to the pixel to be repaired, and extends substantially in the column direction. A plurality of dummy pixels DPX are connected to the dummy signal line DL, and are connected to a plurality of scan lines S1-Sn and a plurality of emission scan lines E1-En.

The scan driver 400 is connected to the scan lines S1-Sn of the display panel 300, and applies scan signals which may be a voltage for turning on switching transistors of the pixel PX and the dummy pixel DPX or a low voltage for turning the same off, to the scan lines S1-Sn.

The data driver 500 is connected to the data lines D1-Dm of the display panel 300 and applies the data signal to the data lines D1-Dm. The data driver 500 may select a data signal from all suitable gray voltages relating to luminance of the pixel PX, or may divide gray voltages of a limited number to generate a desired data signal.

The emission scan driver 600 is connected to the emission scan lines E1-En of the display panel 300, and applies emission scan signals which may be a voltage for turning on the emission transistors of the pixel PX and the dummy pixel DPX or a low voltage for turning the same off, to the emission scan lines E1-En.

The signal controller 700 controls the scan driver 400, the data driver 500, and the emission scan driver 600.

The driving devices 400, 500, 600, and 700 may be directly mounted as at least one single IC chip on the display panel 300, may be mounted on a flexible printed circuit film (not shown) and be attached as a tape carrier package (TCP) to the display panel 300, or may be mounted on an additional printed circuit board (PCB) (not shown). Differing from this, the driving devices 400, 500, 600, and 700 may be integrated on the display panel 300 together with the signal lines (S1-Sn, D1-Dm, and E1-En) and switching transistors. Further, the driving devices 400, 500, 600, and 700 may be integrated into a single chip, and at least one of them or at least one circuit element configuring them may be provided outside the single chip.

Referring to FIG. 2, for example, the pixel PX connected to the i-th (i=1, 2, . . . , n) scan line Si and the j-th (j=1, 2, . . . , m) data line Dj includes an organic light emitting element LD, a driving transistor T1, a storage capacitor Cst, and a plurality of switching transistors (T2, T3, T4, T5, T6, and T7). The pixel PX shown in FIG. 2 exemplifies a pixel for using a data voltage for the data signal.

The driving transistor T1 and a plurality of switching transistors T2-T7 each have a control terminal and two input/output terminals. As shown in FIG. 2, the driving transistor T1 and the plurality of switching transistors T2-T7 may be p-channel field effect transistors (FET) made of an amorphous silicon or a polysilicon, and the control terminal and the two input/output terminals may be a gate, a source, and a drain, respectively. Alternately, at least one of the driving transistor T1 and the switching transistors (T2-T7) may be an n-channel field effect transistor. A connection relationship of the driving transistor T1, the switching transistors T2-T7, the capacitor Cst, and the organic light emitting element LD to be described may be modified in a suitable manner.

The switching transistor T2 includes a control terminal connected to the scan line Si, a first input/output terminal connected to the data line Dj, and a second input/output terminal connected to a first input/output terminal of the driving transistor T1. The switching transistor T2 transmits the applied data voltage Vdata to the data line Dj in response to a low-voltage scan signal applied to the scan line Si.

The switching transistor T3 includes a control terminal connected to the scan line Si, and a first input/output terminal and a second input/output terminal connected to a control terminal and a second input/output terminal of the driving transistor Td. The switching transistor T3 diode-connects the driving transistor T1 in response to the low-voltage scan signal applied to the scan line Si.

The storage capacitor Cst is connected between the control terminal of the driving transistor T1 and a driving voltage line for supplying a driving voltage ELVDD. The storage capacitor Cst charges a voltage corresponding to the data voltage Vdata through the diode-connected driving transistor T1 when the switching transistors T2 and T3 are turned on in response to the low-voltage scan signal applied to the scan line Si, and it maintains the same when the switching transistors T2 and T3 are turned off.

The switching transistor T4 includes a control terminal connected to an initializing scan line Gi, a first input/output terminal connected to the control terminal of the driving transistor T1, and a second input/output terminal connected to an initialization voltage line for supplying an initialization voltage Vint. The switching transistor T4 is turned on in response to the low-voltage initializing scan signal applied to the initializing scan line Gi, and initializes a voltage at a node of the control terminal of the driving transistor T1 and the capacitor Cst as an initialization voltage Vint.

Control terminals of the switching transistors T5 and T6 are connected to the emission scan line Ei. The switching transistor T5 includes a first input/output terminal connected to the driving voltage line ELVDD and a second input/output terminal connected to the first input/output terminal of the driving transistor T1. The switching transistor T6 includes a first input/output terminal connected to the second input/output terminal of the driving transistor T1 and a second input/output terminal connected to the organic light emitting element LD. The switching transistors T5 and T6 are turned on in response to the low-voltage emission scan signal applied to the emission scan line Ei, and form a current path among the driving voltage line ELVDD, the driving transistor T1, and the organic light emitting element LD. Therefore, the driving transistor T1 supplies an output current that is variable by a voltage between the control terminal and the first input/output terminal, that is, the voltage charged in the capacitor Cst to the organic light emitting element LD.

The organic light emitting element LD may be an organic light emitting diode (OLED), and includes an anode connected to the second input/output terminal of the switching transistor T6 and a cathode connected to the common voltage ELVSS. The organic light emitting element LD displays an image by generating light with different intensities according to the output current of the driving transistor T1.

The organic light emitting element LD may display one of primary colors. The primary colors may exemplarily include red, green, and blue, and desired colors may be displayed by a spatial sum or a temporal sum of the three primary colors. Some organic light emitting element LDs may emit white light. As a result, luminance can be increased. Alternatively, organic light emitting elements LD of the pixels PX may emit white light, and some subpixels PX may further include a color filter (not shown) that changes white light emitted from the organic light emitting elements LD into one primary color light.

Here, a bundle of pixels for expressing desired colors may include three pixels for expressing red, green, and blue, respectively, and may further include a pixel for expressing white.

The switching transistor T7 includes a control terminal connected to the initializing scan line Gi, a first input/output terminal connected to the initialization voltage line Vint, and a second input/output terminal connected to the second input/output terminal of the switching transistor T6, that is, the anode of the organic light emitting element LD. The switching transistor T7 is turned on in response to the low-voltage initializing scan signal applied to the initializing scan line Gi, and initializes the voltage at the anode of the organic light emitting element LD as the initialization voltage Vint.

A method for driving an organic light emitting device according to an embodiment will now be described with reference to FIG. 3.

Figure 3:
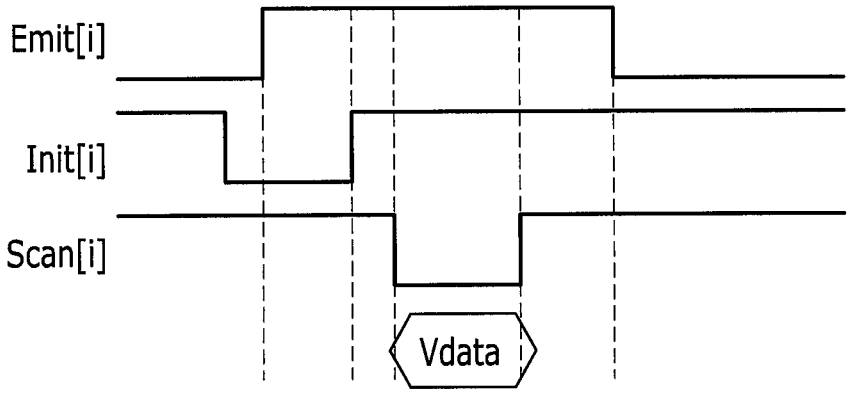
FIG. 3 shows signal timing of an organic light emitting device according to a first embodiment.

FIG. 3 shows signal timing of an organic light emitting device according to a first embodiment.

Referring to FIG. 1 to FIG. 3, while an emission scan signal Emit[i] with a high-voltage Vgh is applied to the emission scan line Ei, an initializing scan signal Init[i] with a low-voltage Vgl is applied to the initializing scan line Gi. The switching transistors T4 and T7 are turned on, and a node at which the control terminal of the driving transistor T1 meets the capacitor Cst and a node at which the anode of the organic light emitting element LD meets the switching transistor T6 are initialized with the initialization voltage Vint. Therefore, the voltage of the capacitor Cst and a voltage charged in a parasitic capacitance component (a parasitic capacitor hereinafter) of the organic light emitting element LD may be initialized.

The emission scan signal Emit[i] with the high-voltage Vgh is applied to the emission scan line Ei, the initializing scan signal Init[i] of the initializing scan line Gi is switched to the high voltage Vgh, and a scan signal Scan[i] with the low-voltage Vgl is applied to the scan line Si. The switching transistor T3 is turned on to diode-connect the driving transistor T1. The switching transistor T2 is turned on to transmit the data voltage Vdata provided by the data line Dj to the first input/output terminal of the driving transistor T1. In this instance, when a threshold voltage of the diode-connected driving transistor T1 is Vth, a voltage (Vdata−Vth) runs at the control terminal of the driving transistor T1. Therefore, a voltage [ELVDD−(Vdata−Vth)] is stored in the capacitor Cst.

The scan signal Scan[i] of the scan line Si is switched to the high voltage Vgh, and the emission scan signal Emit[i] of the emission scan line Ei is switched to the low voltage Vgl. Therefore, the switching transistors T5 and T6 are turned on, and the current $I_{LD}$ provided by the driving transistor T1 flows to the organic light emitting element LD to allow the organic light emitting element LD to emit light with brightness corresponding to the current. In this instance, the current $I_{LD}$ output by the driving transistor T1 is determined as expressed in Equation 1 so it may not be influenced by a variation of the threshold voltage of the driving transistor T1.

$$I_{LD} = \frac{\beta}{2} \times (Vgs - Vth)^2 = \frac{\beta}{2} \times ((ELVDD - (Vdata - Vth)) - Vth)^2 = \frac{\beta}{2} \times (ELVDD - Vdata)^2 \quad \text{Equation 1}$$

Here, Vgs is a gate-source voltage difference of the driving transistor T1, and β is a parameter determined by a characteristic of the driving transistor T1.

In an embodiment, the scan line [S(i−1)] of the previous row rather than the initializing scan line Gi may be connected to the control terminals of the switching transistors T4 and T7 of the pixel PX. The switching transistors T4 and T7 may be turned on in response to the low voltage of the scan signal Scan[i−1] of the previous scan line [S(i−1)] applied before the scan signal Scan[i] of the scan line Si. In another embodiment, different signal lines may be connected to the control terminal of the switching transistor T4 and the control terminal of the switching transistor T7.

A repairing method in an organic light emitting device according to an embodiment will now be described with reference to FIG. 4 to FIG. 6.

Figure 4:
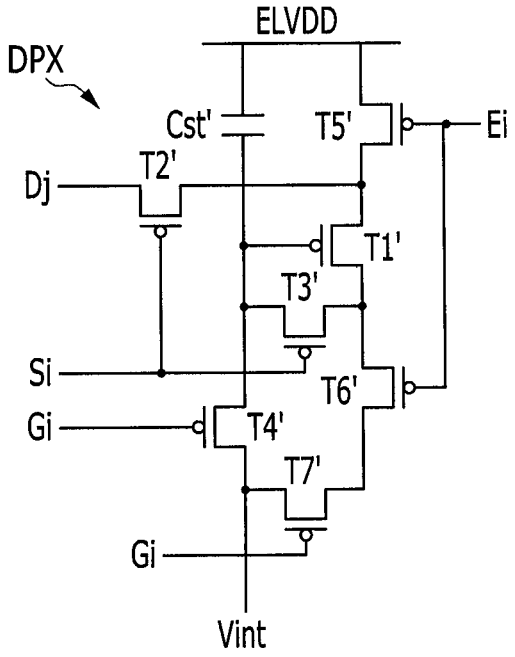
FIG. 4 shows an equivalent circuit diagram of a dummy pixel of an organic light emitting device according to an embodiment.
Figure 5:
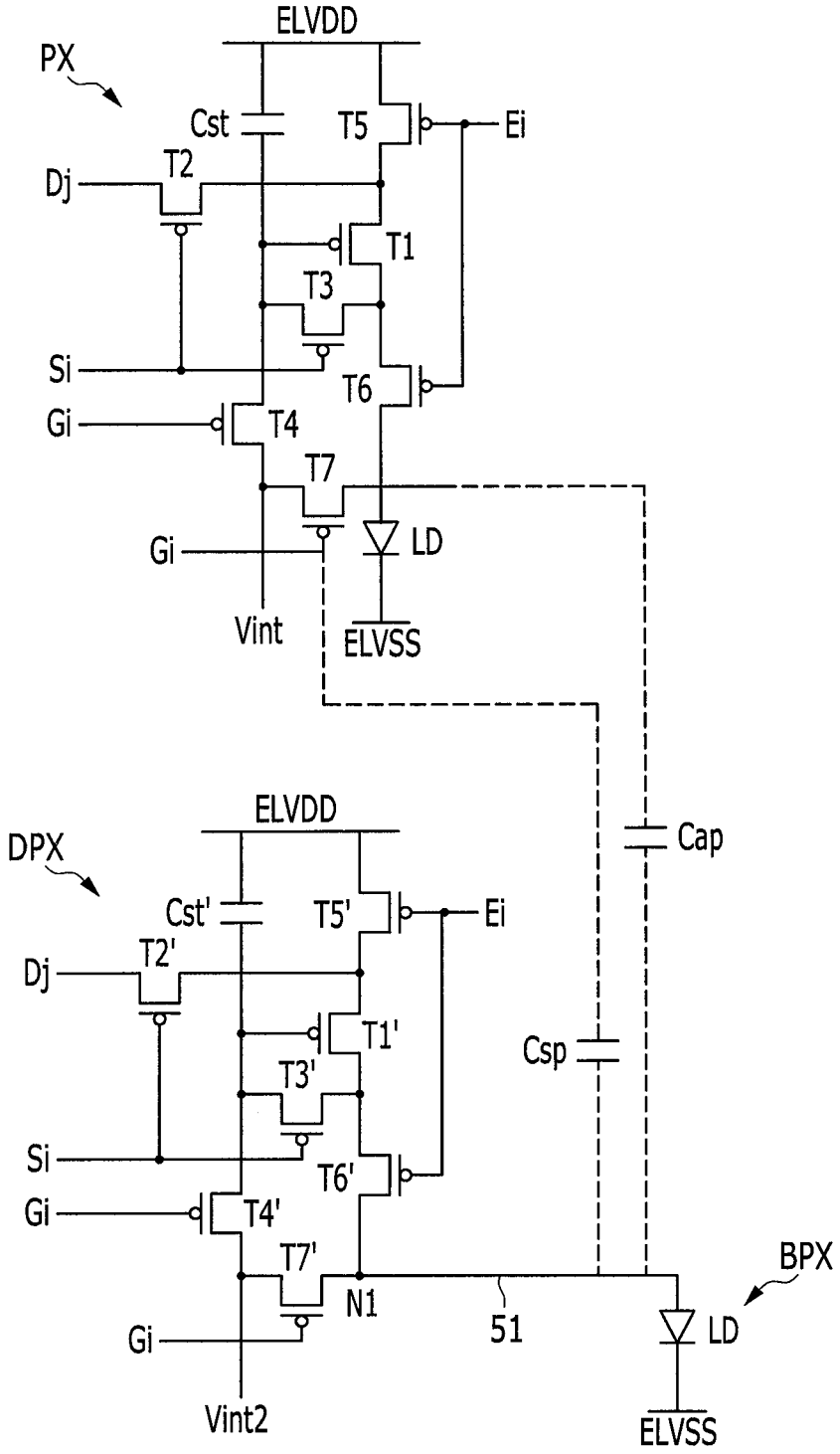
FIG. 5 shows repairing of a bad pixel in an organic light emitting device according to an embodiment.
Figure 6:
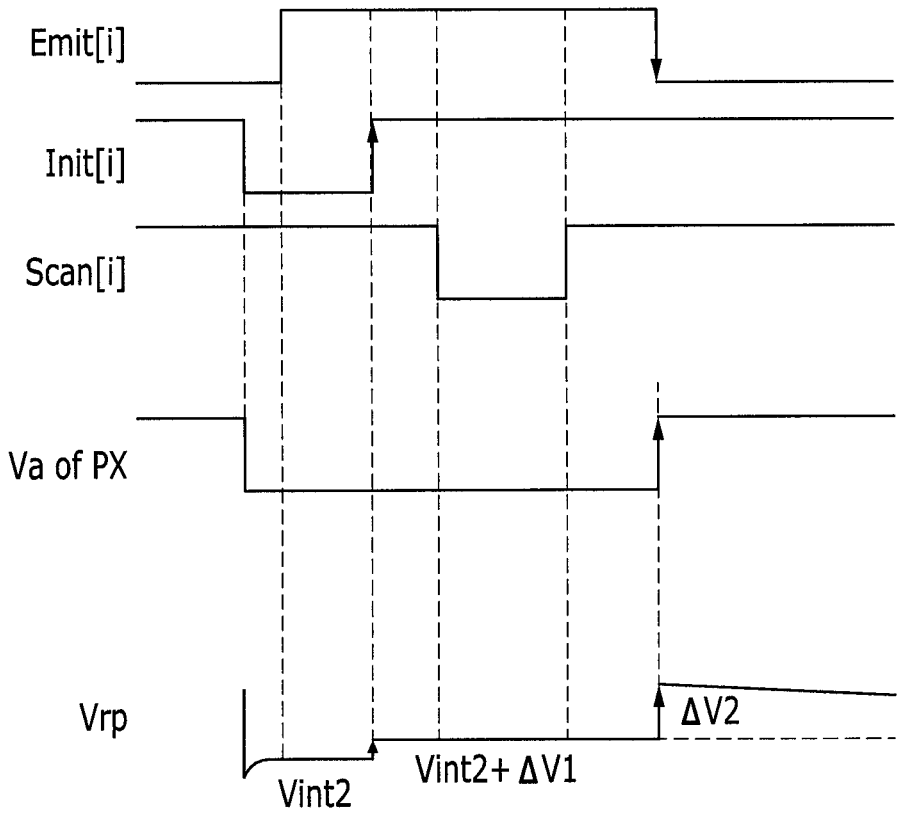
FIG. 6 shows signal timing of an organic light emitting device according to an embodiment.

FIG. 4 shows an equivalent circuit diagram of a dummy pixel of an organic light emitting device according to an embodiment, FIG. 5 shows repairing of a bad pixel in an organic light emitting device according to an embodiment, and FIG. 6 shows signal timing of an organic light emitting device according to an embodiment.

Referring to FIG. 4, a dummy pixel DPX, for example, the dummy pixel DPX connected to the i-th scan line Si, may have substantially the same configuration as the pixel PX. The dummy pixel DPX may not have an organic light emitting element LD. The dummy pixel DPX includes a driving transistor T1', a storage capacitor Cst', and a plurality of switching transistors T2', T3', T4', T5', T6', and T7'.

A first input/output terminal of the switching transistor T2' is connected to a dummy signal line DL, and a second input/output terminal of the switching transistor T4' and a first input/output terminal of the switching transistor T7' are connected to an initialization voltage line for supplying an initialization voltage Vint2. The initialization voltage Vint2 may be equal to the initialization voltage Vint applied to the pixel PX.

Another connection relationship among the driving transistor T1', the storage capacitor Cst', and the plurality of switching transistors T2', T3', T4', T5', T6', and T7' may correspond to the connection relationship among the driving transistor T1, the storage capacitor Cst, and the switching transistors T2, T3, T4, T5, T6, and T7 of the pixel PX shown in FIG. 2.

Referring to FIG. 5, for example, when the pixel BPX connected to the i-th scan line Si and the j-th data line Dj is bad, wiring between the anode of the organic light emitting element LD of the bad pixel BPX and the switching transistor T6 is disconnected, and a node N1 between the anode of the organic light emitting element LD of the bad pixel BPX and the switching transistors T6' and T7' of the dummy pixel DPX is connected by a repair wire 51. The data signal provided by the data line Dj is transmitted to the dummy signal line DL. The organic light emitting element LD of the bad pixel BPX may normally emit light by the current transmitted by the driving transistor T1' of the dummy pixel DPX.

As shown in FIG. 5, a parasitic capacitor Cap may be formed by the repair wire 51 connecting the organic light emitting element LD and the node N1 and extending in the row direction and an anode wire (not shown) connecting organic light emitting elements LD of the pixels PX neighboring in the row direction. The parasitic capacitor Csp may also be formed by the repair wire 51 extending in the row direction and the initializing scan line Gi connected to the control terminals of the transistors T3 and T6 of the pixels PX.

Referring to FIG. 6, a low-voltage Vgl initializing scan signal Init[i] is transmitted to the initializing scan line Gi to turn on the switching transistors T4' and T7' of the dummy pixel DPX. The voltage Vrp of the repair line 51, that is, the voltage at the anode of the organic light emitting element LD of the bad pixel BPX is initialized as an initialization voltage Vint2.

The initializing scan signal Init[i] is switched to the high voltage Vgh. A scan signal Scan[i] having the low-voltage Vgl is transmitted to the scan line Si, and the corresponding data voltage Vdata is transmitted to the bad pixel BPX connected to the repair line 51 through the dummy signal line DL. The switching transistors T2' and T3' are turned on to store the voltage corresponding to the data voltage Vdata in the capacitor Cst'.

The scan signal Scan[i] of the scan line Si is switched to the high voltage Vgh. The low-voltage Vgh emission signal Emit[i] is transmitted to the emission scan line Ei to turn on the switching transistors T5' and T6'. The current output by the driving transistor T1' is transmitted to the organic light emitting element LD of the bad pixel BPX through the repair line 51 according to the voltage charged in the capacitor Cst' so the organic light emitting element LD emits light. The bad pixel BPX may be accordingly repaired by the dummy pixel DPX.

When the bad pixel BPX expresses the original low gray or a black gray, it may express a brighter gray than the original gray because of the parasitic capacitors Cap and Csp.

In some embodiments, when the initializing scan signal Init[i] is switched to the high voltage Vgh from the low voltage Vgl, the voltage Vrp of the repair line 51 increases from the initialization voltage Vini2 by the parasitic capacitors Cap and Csp. A voltage increment ΔV1 of the repair line 51 may be determined as expressed in Equation 2.

$$\Delta V1 = (Vgh - Vgl) \times \frac{Csp}{Ctotal} \quad \text{Equation 2}$$

Here, Ctotal is a total capacitance component of the parasitic capacitors Cap and Csp, and Csp is a capacitance component of the parasitic capacitor Csp.

When another pixel PX arranged in the same row as the bad pixel BPX expresses a high gray and the emission scan signal Emit[i] is switched to the low voltage Vgl from the high voltage Vgh, the driving transistor T1 of the other pixel PX supplies the current for expressing the high gray to the organic light emitting element LD. Therefore, the anode voltage Va of the organic light emitting element LD of the other pixel PX increases. The voltage increment ΔV corresponds to the voltage [Vld−(Vint−ELVSS)] generated by subtracting a difference between the initialization voltage Vint and the common voltage ELVSS from the voltage Vld between the anode and the cathode of the organic light emitting element LD.

The voltage Vrp of the repair line 51 is increased, that is, boosted by an increase of the anode voltage Va of the other pixel PX by the parasitic capacitors Cap and Csp. A voltage increment ΔV2 of the repair line 51 may be determined as expressed in Equation 3.

$$\Delta V2 = \Delta V \times \frac{Cap}{Ctotal} \quad \text{Equation 3}$$

Hence, when the bad pixel BPX expresses the original black gray or low gray, the voltage Vemit expressed in Equation 4 may be used for emission by the organic light emitting element LD of the bad pixel BPX. The voltage Vemit becomes greater than 0 volts because of the voltage increments ΔV1 and ΔV2 by the parasitic capacitors Csp and Cap so the organic light emitting element LD emits light (e.g., light with a predetermined gray) and thus fails to express the black gray or the low gray.

$$Vemit=Vint2+\Delta V1-ELVSS-Vth_LD+\Delta V2 \quad \text{Equation 4}$$

Here, Vth_LD is a threshold voltage of the organic light emitting element LD.

Figure 7:
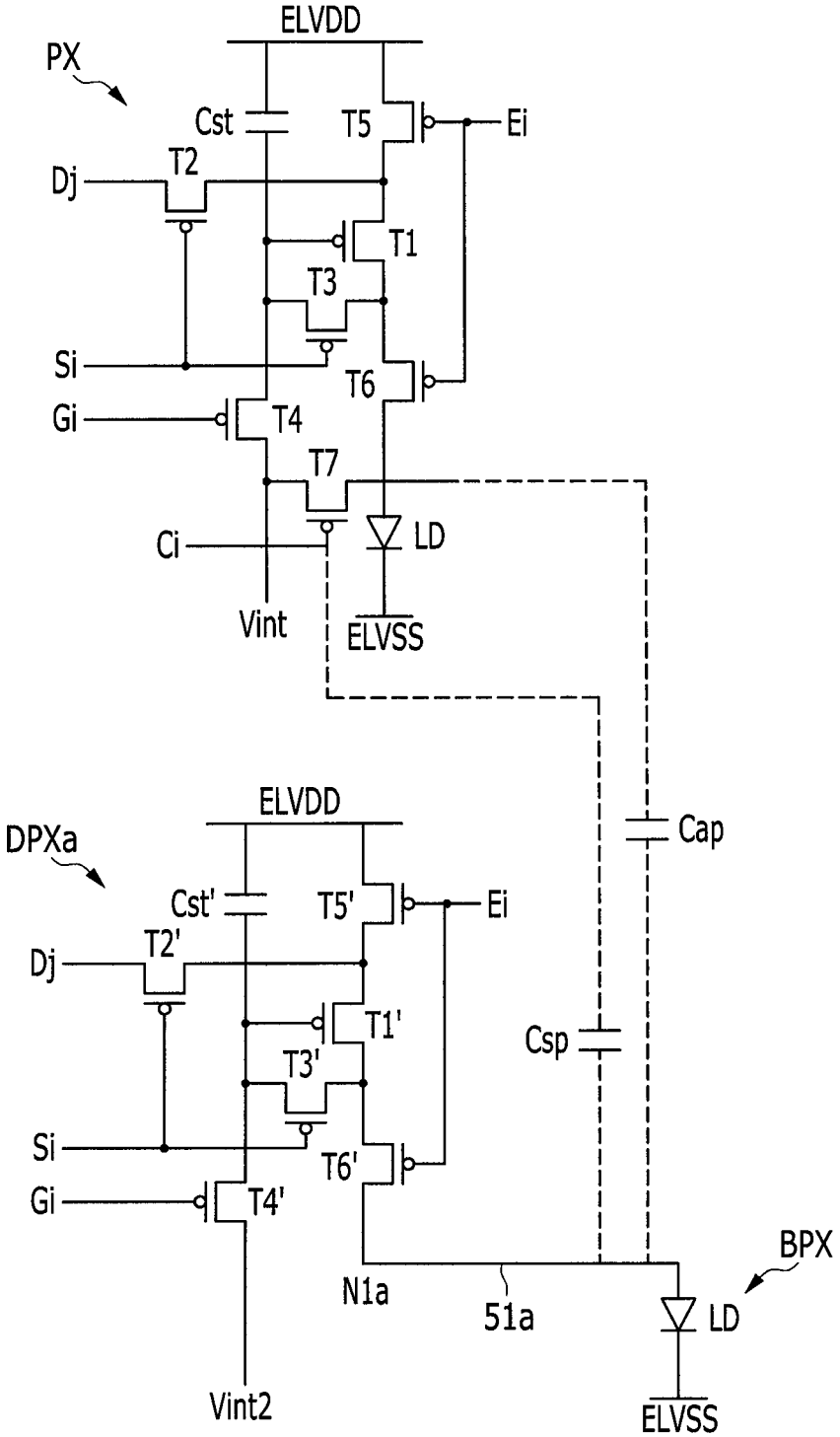
FIG. 7 shows repairing of a bad pixel in an organic light emitting device according to another embodiment.
Figure 8:
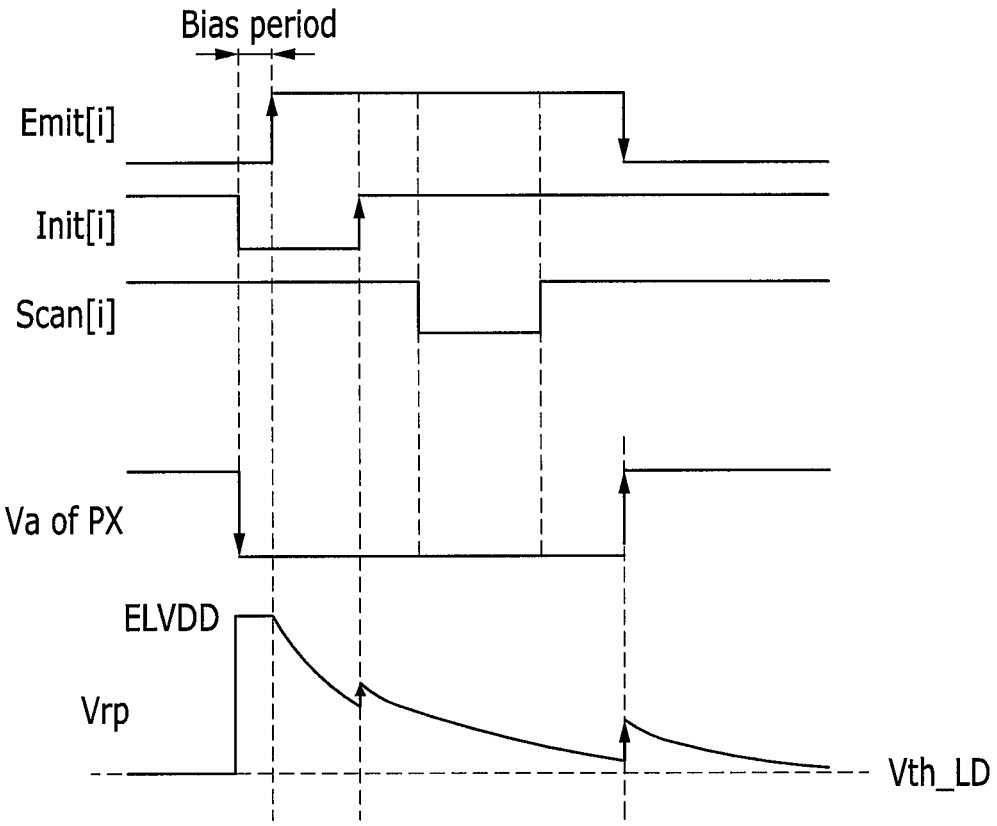
FIG. 8 shows signal timing of an organic light emitting device according to another embodiment.

FIG. 7 shows repairing of a bad pixel in an organic light emitting device according to another embodiment, and FIG. 8 shows signal timing of an organic light emitting device according to another embodiment.

Referring to FIG. 7, differing from the dummy pixel DPX shown in FIG. 4 and FIG. 5, the switching transistor T7' is not connected between the node N1*a* and the initialization voltage Vint2 on the dummy pixel DPXa. That is, the dummy pixel DPXa does not initialize the repair line 51*a* to prevent or substantially prevent the repair line 51*a* from being boosted after being initialized.

FIG. 7 shows that the control terminal of the switching transistor T7 is connected not to the initializing signal line Gi, but to a compensation signal line Ci. In one embodiment, a compensation signal Comp[i] applied to the compensation signal line Ci may correspond to the initializing signal Init[i].

As shown in FIG. 8, during an on-bias section in which the emission signal Emit[i] is not switched to the high voltage Vgh after the initializing signal Init[i] is switched to the low voltage Vgl, the current is supplied to the repair line 51*a* from the driving voltage ELVDD through the turned-on switching transistors T5' and T6' so the voltage Vpr at the repair line 51*a* may substantially increase to the driving voltage ELVDD.

When the bad pixel BPX expresses the black gray, the voltage Vpr at the repair line 51*a* is discharged through the parasitic capacitor to be substantially reduced to the voltage corresponding to (ELVSS+Vth_LD). When the initializing signal Init[i] is switched to the high voltage Vgh from the low voltage Vgl, the voltage Vpr at the repair line 51*a* may be increased by ΔV1 volts, and when the emission signal Emit[i] is switched to the low voltage Vgl from the high voltage Vgh, the voltage Vpr at the repair line 51*a* may be increased by ΔV2 volts.

When the black gray is to be expressed, the organic light emitting element LD of the bad pixel BPX may erroneously emit light by the voltage at the repair line 51*a* that is increased for the on-bias section.

Figure 9:
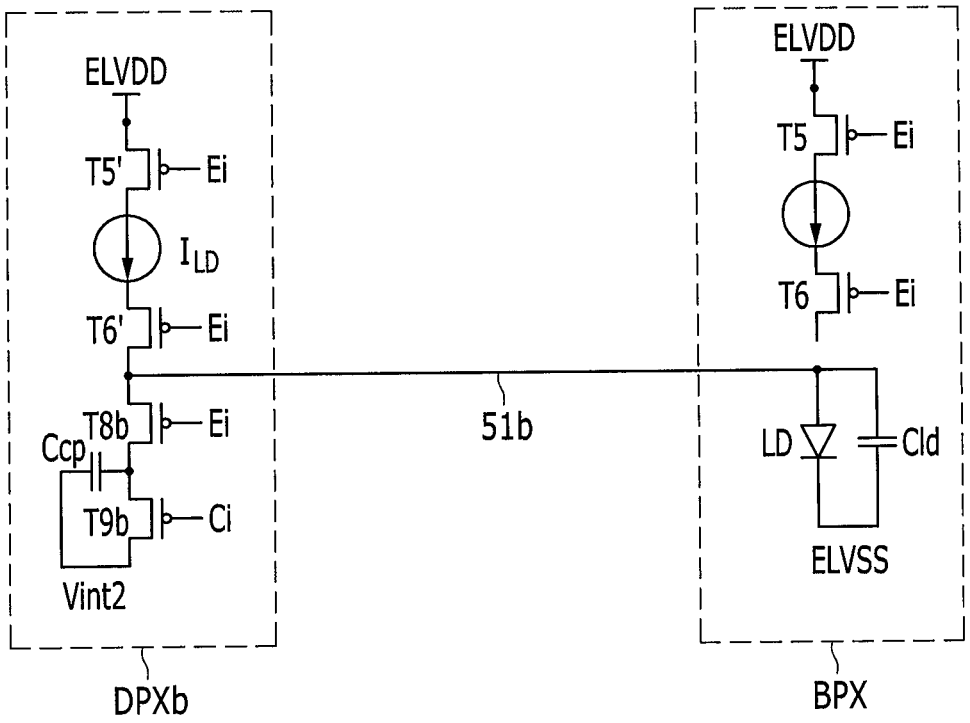
FIG. 9 shows repairing of a bad pixel in an organic light emitting device according to yet another embodiment.
Figure 10:
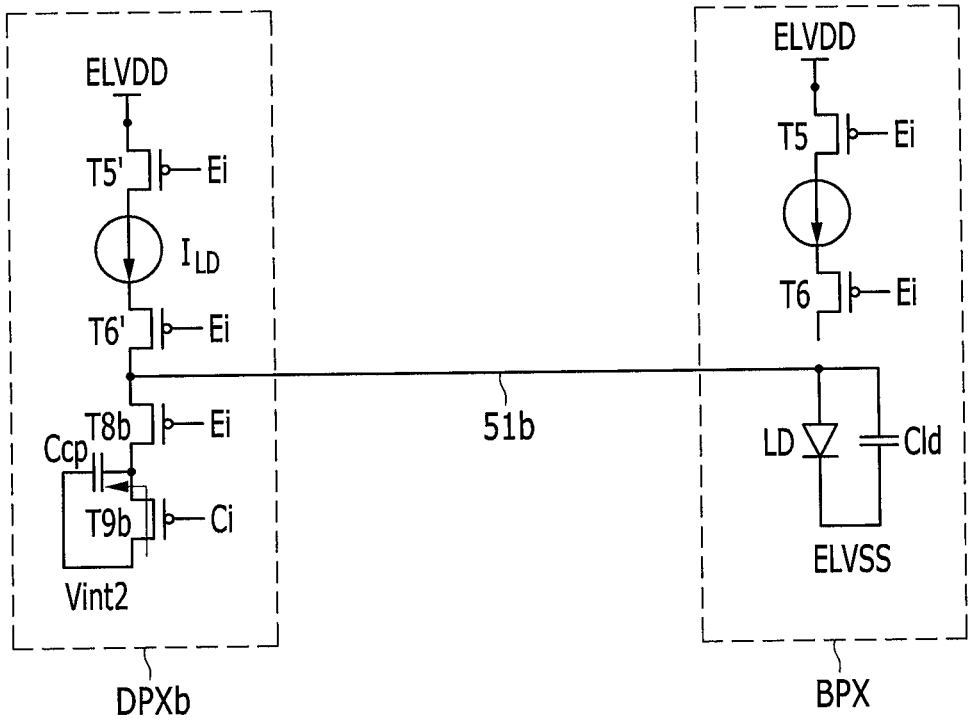
FIG. 10, FIG. 11, and FIG. 12 show a flow of current in a dummy pixel and a bad pixel shown in FIG. 9.
Figure 11:
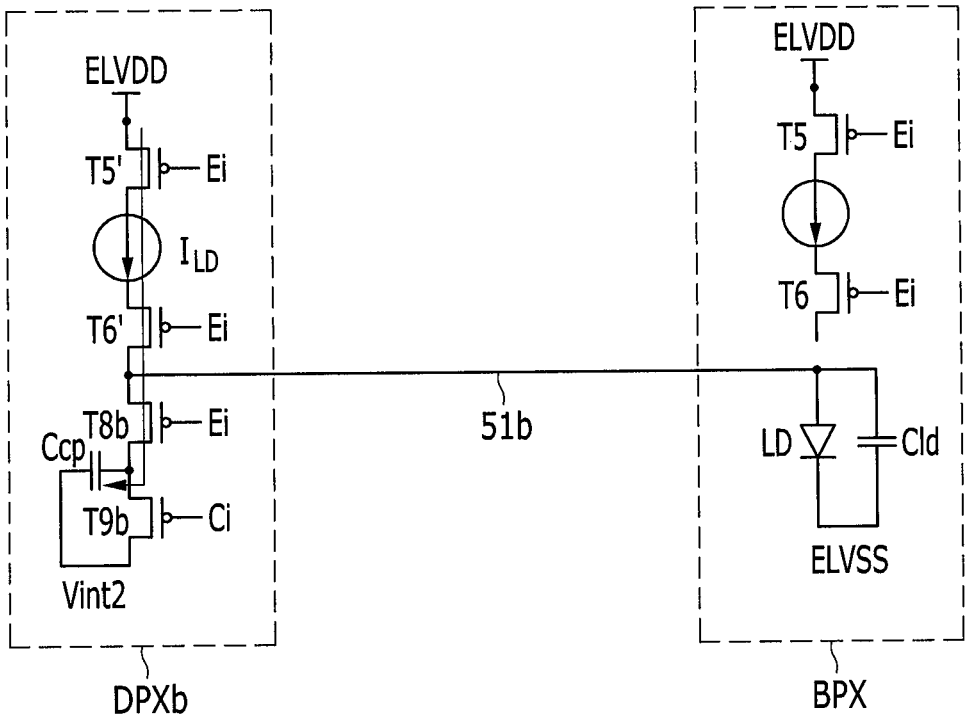
Figure 12:
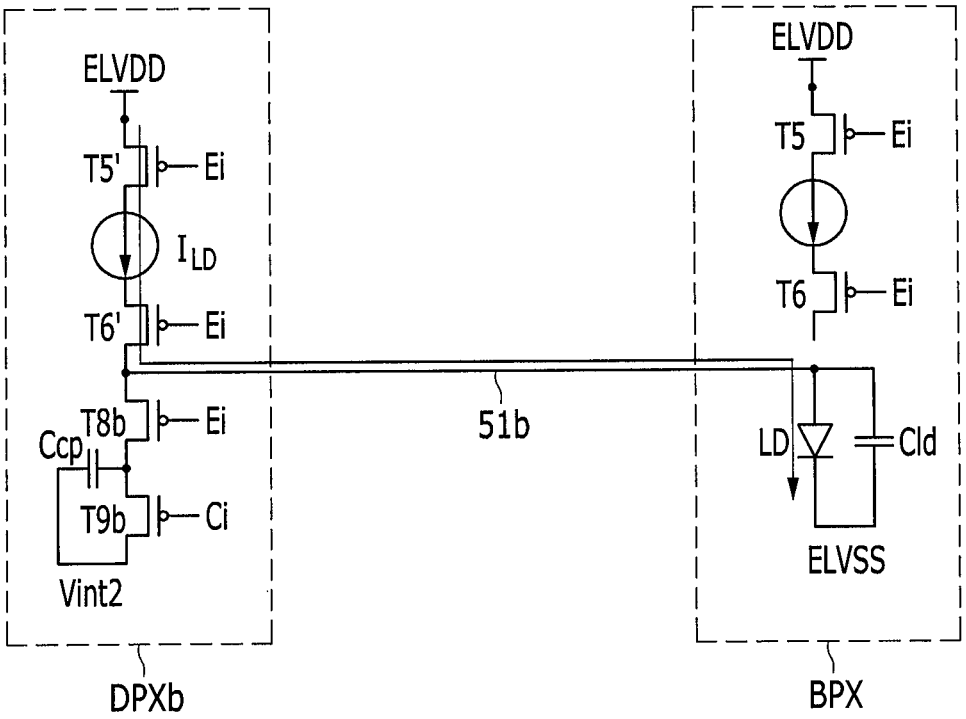

FIG. 9 shows repairing of a bad pixel in an organic light emitting device according to yet another embodiment, and FIG. 10, FIG. 11, and FIG. 12 show a flow of current in a dummy pixel and a bad pixel shown in FIG. 9.

Referring to FIG. 9, the dummy pixel DPXb includes a dummy pixel driving circuit and a charge sharing circuit. The dummy pixel driving circuit includes switching transistors T5' and T6' and a current source $I_{LD}$, and the charge sharing circuit includes switching transistors T8*b* and T9*b* and a capacitor Ccp. The current source ($I_{LD}$) represents a driving current supplied by the driving transistor (T1' of FIG. 4) according to the connection relationship of the driving transistor and other switching transistors (e.g., T1', T2', and T3' in FIG. 4).

The switching transistors T5' and T6' exemplarily have the same or substantially the same connection relationship as the switching transistors T5' and T6' of the dummy pixel DPX shown in FIG. 7. That is, the control terminals of the switching transistors T5' and T6' are connected to the emission signal line Ei. The switching transistor T5' includes a first input/output terminal connected to the driving voltage line for supplying the driving voltage ELVDD, and a second input/output terminal connected to an input terminal of the current source $I_{LD}$, for example, the first input/output terminal of the driving transistor (T1' of FIG. 7). The switching transistor T6' includes a first input/output terminal connected to the output terminal of the current source $I_{LD}$, for example, the second input/output terminal of the driving transistor (T1 of FIG. 7), and a second input/output terminal connected to the repair line 51*b*.

The switching transistor T8*b* includes a control terminal connected to the emission signal line Ei, a first input/output terminal connected to the repair line 51*b*, and a second input/output terminal connected to a connection node of a capacitor Ccp and a switching transistor T9*b*.

The switching transistor T9*b* is a transistor for initializing the repair line 51*b*, and it includes a control terminal connected to the compensation signal line Ci, a first input/output terminal connected to the capacitor Ccp, and a second input/output terminal connected to the initialization voltage line for supplying an initialization voltage Vint2. It is assumed in this instance that the compensation signal line Ci is connected to the control terminal of the switching transistor (e.g., T7 of FIG. 7) for initialization of the anode of the organic light emitting element LD of the other pixel PX.

The capacitor Ccp includes a first terminal connected to a connection node of the first input/output terminal of the switching transistor T9*b* and the second input/output terminal of the switching transistor T8*b*, and a second terminal connected to the initialization voltage line for supplying the initialization voltage Vint2.

The repair line 51*b* is connected to the anode of the organic light emitting element LD of the bad pixel BPX. The capacitor Cld represents a parasitic capacitance of the organic light emitting element LD. Regarding the bad pixel BPX, the anode of the organic light emitting element LD is disconnected from a pixel circuit of the bad pixel BPX, for example, the second input/output terminal of the switching transistor T6.

When the compensation signal Comp[i] applied to the compensation signal line Ci has a low voltage Vgl while the emission signal Emit[i] has the high voltage Vgh, the switching transistor T9*b* is turned on. The capacitor Ccp is initialized by the initialization voltage Vint2 as shown in FIG. 10. The parasitic capacitors Csp and Cap of the repair line 51*b* and the parasitic capacitor Cld of the organic light emitting element LD of the bad pixel BPX are not initialized but are pre-charged with the previous voltage by the turned off switching transistor T8*b*. For example, the switching transistor (e.g., T7 of FIG. 7) of the neighboring pixel PX in the same row is turned on to initialize the anode of the organic light emitting element LD with the initialization voltage Vint.

The compensation signal Comp[i] is switched to the high voltage Vgh and the emission signal Emit[i] is switched to the low voltage Vgl. The switching transistors T5', T6', and T8*b* of the dummy pixel DPXb are turned on to form a current path from the driving voltage ELVDD to the capacitor Ccp as shown in FIG. 11. In this instance, the parasitic capacitors Csp and Cap of the repair line 51*b* and the parasitic capacitor Cld of the organic light emitting element LD of the bad pixel BPX are not initialized so the current source $I_{LD}$, that is, the current supplied by the driving transistor T1', is used to compensate the voltage of the capacitor Ccp that is initialized with the initialization voltage Vint2. The charges stored in the parasitic capacitors Csp, Cap, and Cld are transmitted to the capacitor Ccp by the charge sharing between the parasitic capacitors Csp, Cap, and Cld and the capacitor Ccp to reduce the voltage of the repair line 51*b*. The current is supplied through the driving transistor T1 on the neighboring pixel PX in the same row to charge the parasitic capacitor of the organic light emitting element LD.

When the capacitor Ccp and the parasitic capacitor Cld of the bad pixel BPX are charged by the above-noted current, the current supplied by the current source $I_{LD}$ is used to emit the organic light emitting element LD as shown in FIG. 12.

Accordingly, part of the current output by the driving transistor T1' is used to compensate the voltage reduced by the charge sharing between the capacitor Ccp and the parasitic capacitor, thereby offsetting the effect caused by boosting by the parasitic capacitor. The bad pixel BPX may thus normally express the low gray or the black gray.

In an embodiment, capacitance of the capacitor Ccp and the parasitic capacitor Cld may be set to substantially correspond to each other. The current used to charge the capacitor Ccp may be set to be close to the current used to charge the parasitic capacitor Cld of the organic light emitting element LD of the other pixel PX.

Figure 13:
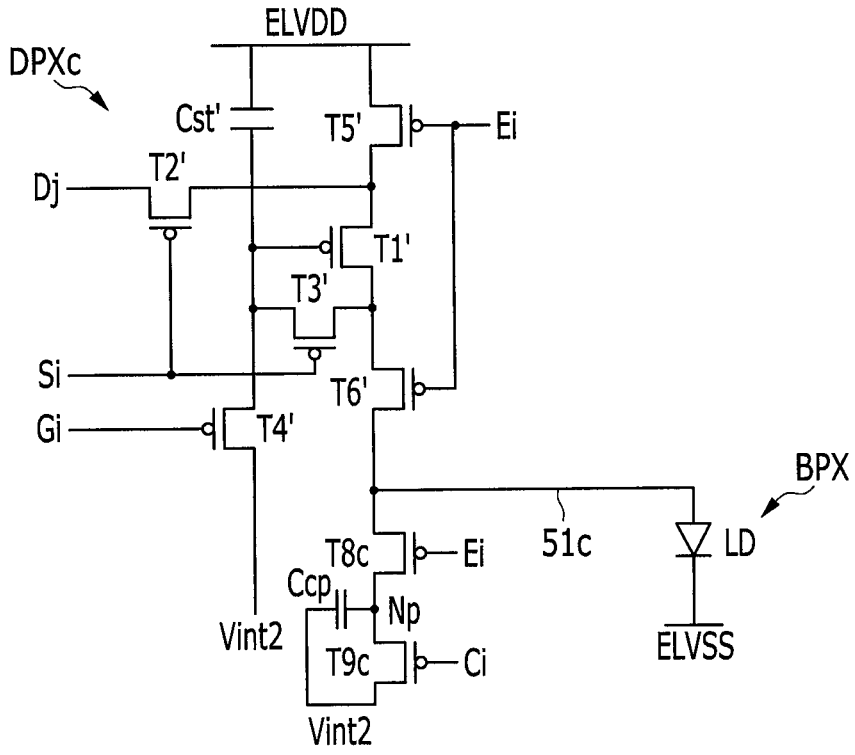
FIG. 13 shows a dummy pixel in an organic light emitting device according to yet another embodiment.
Figure 14:
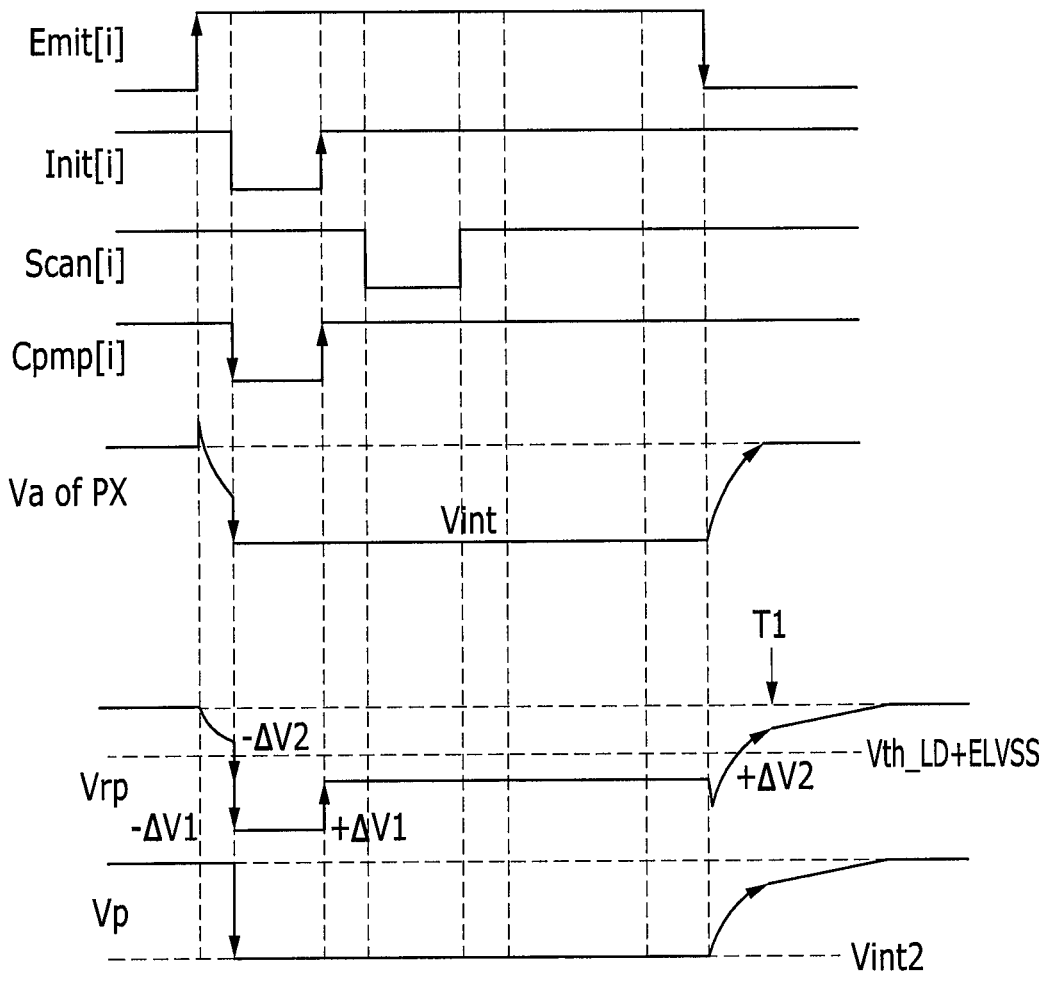
FIG. 14 and FIG. 15 show signal timing of an organic light emitting device shown in FIG. 13.
Figure 15:
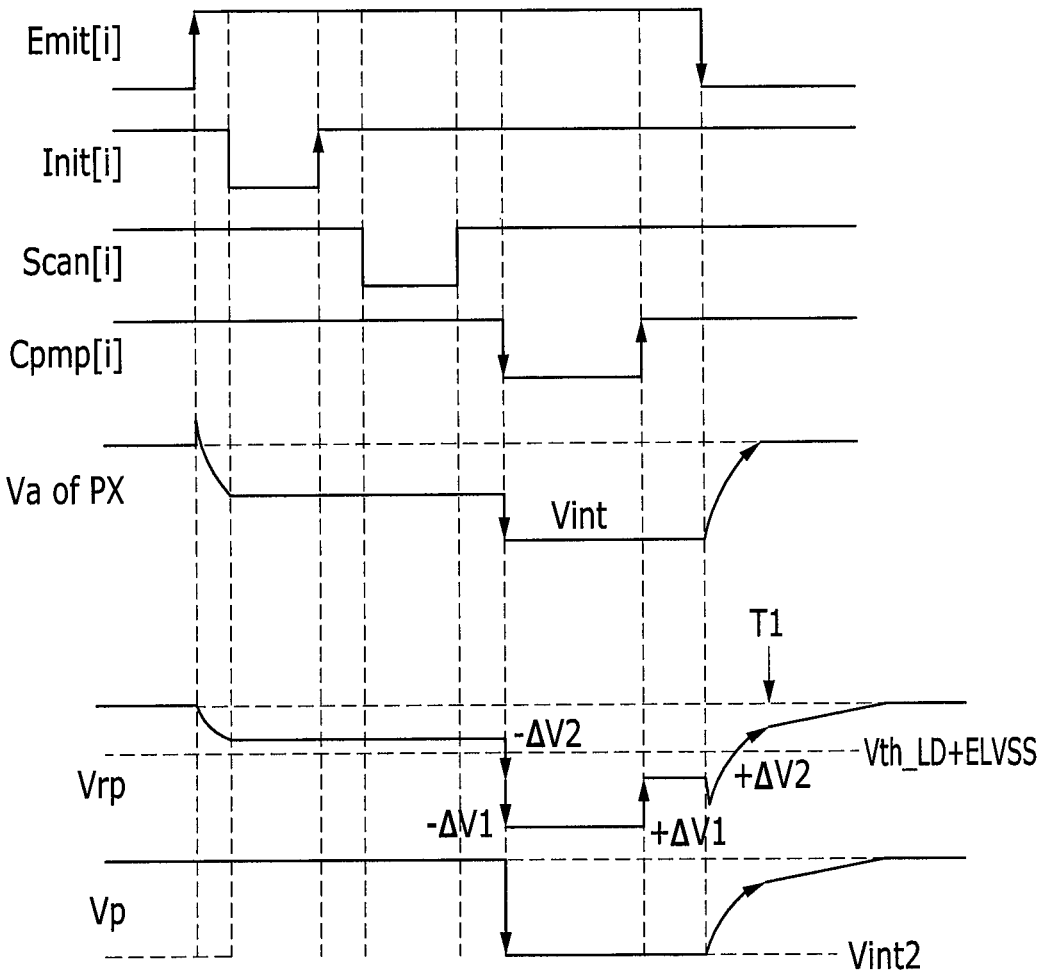

FIG. 13 shows a dummy pixel in an organic light emitting device according to yet another embodiment and FIG. 14 and FIG. 15 show a signal timing of an organic light emitting device shown in FIG. 13.

Referring to FIG. 13, the dummy pixel DPXc includes a dummy pixel driving circuit and a charge sharing circuit. The dummy pixel driving circuit includes a driving transistor T1', a capacitor Cst', and switching transistors T2', T3', T4', T5', and T6', and the charge sharing circuit includes switching transistors T8*c* and T9*c* and a capacitor Ccp.

The driving transistor T1', the capacitor Cst', and the switching transistors T2', T3', T4', T5', and T6' of the dummy pixel driving circuit are connected in a like manner of the dummy pixel DPXa shown in FIG. 7.

The switching transistor T8*b* includes a control terminal connected to the emission signal line Ei, a first input/output terminal connected to the repair line 51*c*, and a second input/output terminal connected to a connection node Np of the capacitor Ccp and the switching transistor T9*c*.

The switching transistor T9*c* includes a control terminal connected to the compensation signal line Ci, a first input/output terminal connected to the connection node Np, and a second input/output terminal connected to the initialization voltage line for supplying the initialization voltage Vint2.

The capacitor Ccp includes a first terminal connected to a connection node Np of the first input/output terminal of the switching transistor T9*b* and the second input/output terminal of the switching transistor T8*b*, and a second terminal connected to the initialization voltage line for supplying the initialization voltage Vint2.

The repair line 51*c* is connected to the anode of the organic light emitting element LD of the bad pixel BPX.

Referring to FIG. 14, when the emission signal Emit[i] is switched to the high voltage Vgh from the low voltage Vgl, the switching transistors (T5 and T6 of FIG. 7) of the neighboring pixel PX in the same row as the bad pixel BPX are turned off. The voltage charged in the parasitic capacitor of the organic light emitting element LD of the neighboring pixel PX is discharged to reduce the anode voltage Va. The switching transistors T5', T6', and T8*c* of the dummy pixel DPXc are turned off so the voltage charged in the parasitic capacitor of the organic light emitting element LD of the bad pixel BPX is discharged and the voltage Vrp of the repair line 51*c* is reduced.

The compensation signal Comp[i] is switched to the low voltage Vgl from the high voltage Vgh and the switching transistor (T7 of FIG. 7) of the neighboring pixel PX is turned on. The anode voltage Va is initialized with the initialization voltage Vint, and the voltage Vrp of the repair line 51*c* is reduced by the parasitic capacitor Cap formed by the anode of the neighboring pixel PX and the repair line 51*c*. For example, the voltage Vrp of the repair line 51*c* may be reduced by ΔV2 volts of Equation 3. The switching transistor T9*c* of the dummy pixel DPXc is turned on to initialize the capacitor Ccp with the initialization voltage Vint2, and the voltage Vp of the connection node Np is reduced to the initialization voltage Vint2.

When the voltage of the compensation signal Comp[i] is reduced, the voltage Vrp of the repair line 51*c* is additionally reduced by the parasitic capacitor Csp formed by the compensation signal line Ci of the neighboring pixel PX and the repair line 51*c*. For example, the voltage Vrp of the repair line 51*c* may be reduced by ΔV1 volts of Equation 2.

The initializing signal Init[i] is switched to the low voltage Vgl from the high voltage Vgh to initialize the voltage at the control terminal of the driving transistor T1' with the initialization voltage Vint2.

The compensation signal Comp[i] and the initializing signal Init[i] are switched to the high voltage Vgh. The voltage Vrp of the repair line 51*c* is increased by the parasitic capacitor Csp according to an increase of the voltage of the compensation signal Comp[i]. For example, the voltage Vrp of the repair line 51*c* may be increased by ΔV1 volts of Equation 2.

The scan signal Scan[i] is switched to the low voltage Vgl and the data voltage corresponding to the bad pixel BPX is applied through the dummy signal line DL. The data voltage is assumed here to be a voltage for expressing the low gray.

The scan signal Scan[i] is switched to the high voltage Vgh and the emission signal Emit[i] is switched to the low voltage. The switching transistors T5', T6', and T8*c* of the dummy pixel DPXc are turned on so the driving transistor T1' outputs a small current corresponding to the low gray. The parasitic capacitors Csp and Cap of the repair line 51*c* and the parasitic capacitor of the organic light emitting element LD of the bad pixel BPX are not initialized so part of the small amount of current output by the driving transistor T1' is used to compensate the voltage of the capacitor Ccp initialized by the initialization voltage Vint2. The charges stored in the parasitic capacitors Csp, Cap, and Cld are transmitted to the capacitor Ccp by the charge sharing between the parasitic capacitors Csp, Cap, and Cld and the capacitor Ccp to reduce the voltage Vpr of the repair line 51*c*.

The current is supplied through the driving transistor T1 on the neighboring pixel PX to charge the parasitic capacitor of the organic light emitting element LD and increase the anode voltage Va of the organic light emitting element LD. The voltage Vrp of the repair line 51*c* also increases by the parasitic capacitors Cap and Csp. For example, when the neighboring pixel PX continues to express the high gray, the voltage Vrp of the repair line 51*c* may increase by ΔV2 volts of Equation 3. The voltage Vp of the connection node Np increases according to the voltage Vrp of the repair line 51*c* by the turned-on switching transistor (T8*c*).

After the time T1 when the charge sharing is finished, the parasitic capacitor of the organic light emitting element LD of the bad pixel BPX and the parasitic capacitor of the repair line 51*c* are charged by the partial current output by the driving transistor T1' of the dummy pixel DPXc, and the voltage Vrp of the repair line 51*d* increases by the voltage corresponding to the low gray.

Referring to FIG. 15, in another embodiment, the compensation signal Comp[i] may have different timing from the initializing signal Init[i]. Regarding the example shown in FIG. 15, the compensation signal Comp[i] is reduced to the low voltage Vgl when the scan signal Scan[i] is switched to the high voltage Vgh from the low voltage Vgl.

Therefore, when the compensation signal Comp[i] is reduced to the low voltage Vgl, the switching transistor (T7 of FIG. 7) of the neighboring pixel PX is turned on. The anode voltage Va is initialized with the initialization voltage Vint, and the voltage Vrp of the repair line 51*c* is reduced by ΔV2 volts of Equation 3 by the parasitic capacitor Cap. The switching transistor T9*c* of the dummy pixel DPXc is turned on to initialize the capacitor Ccp with the initialization voltage Vint2, and the voltage Vp at the connection node Np is reduced to the initialization voltage Vint2.

When the voltage of the compensation signal Comp[i] is reduced, the voltage Vrp of the repair line 51*c* may be reduced by ΔV1 volts of Equation 2 by the parasitic capacitor Csp.

The compensation signal Comp[i] increases to the high voltage Vgh so that the voltage Vrp of the repair line 51*c* may increase by ΔV1 volts by the parasitic capacitor Csp.

The emission signal Emit[i] is switched to the low voltage. Part of the current output by the driving transistor T1' of the dummy pixel DPXc is used to compensate the voltage of the capacitor Ccp initialized with the initialization voltage Vint2. The charges stored in the parasitic capacitors Csp, Cap, and Cld are transmitted to the capacitor Ccp by the charge sharing between the parasitic capacitors Csp, Cap, and Cld and the capacitor Ccp to reduce the voltage of the repair line 51*c*. The anode voltage Va of the organic light emitting element LD increases on the neighboring pixel PX so the voltage Vrp of the repair line 51*c* may increase by ΔV2 volts of Equation 3 by the parasitic capacitor Cap.

After the time T1 when the charge sharing is finished, the parasitic capacitor of the organic light emitting element LD of the bad pixel BPX and the parasitic capacitor of the repair line 51*c* are charged by the partial current output by the driving transistor T1' of the dummy pixel DPXc and the voltage Vrp of the repair line 51*c* increase by the voltage corresponding to the low gray.

According to an embodiment described with reference to FIG. 14 or FIG. 15, part of the current output by the driving transistor T1' is used to compensate the voltage reduced by charge sharing of the capacitor Ccp and the parasitic capacitor thereby offsetting the effect caused by the boosting by the parasitic capacitor. The bad pixel BPX may thus normally express the low gray or the black gray.

Figure 16:
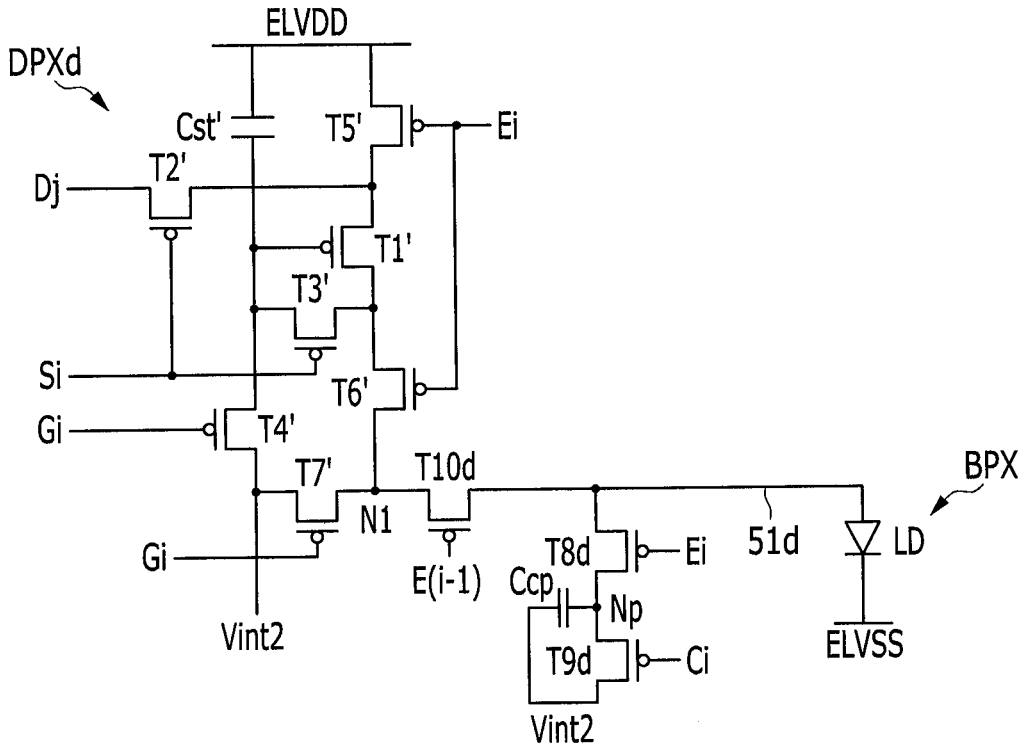
FIG. 16 shows a dummy pixel in an organic light emitting device according to yet another embodiment.
Figure 17:
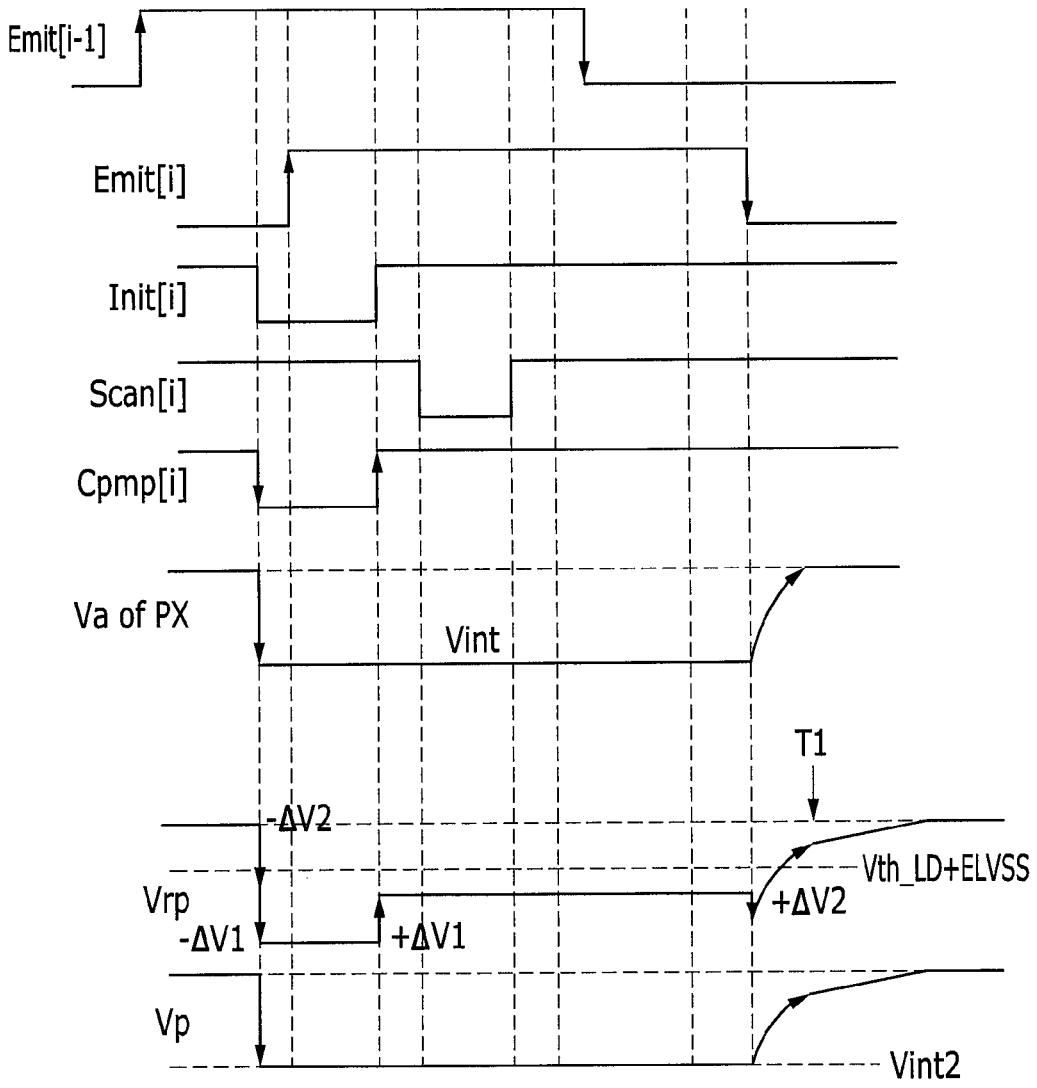
FIG. 17 shows signal timing of an organic light emitting device shown in FIG. 16.

FIG. 16 shows a dummy pixel in an organic light emitting device according to yet another embodiment and FIG. 17 shows a signal timing of an organic light emitting device shown in FIG. 16.

Referring to FIG. 16, the dummy pixel DPXd includes a driving transistor T1', a capacitor Cst', switching transistors T2', T3', T4', T5', T6', and T7', switching transistors T8*d*, T9*d*, and T10*d*, and a capacitor Ccp.

The driving transistor T1', the capacitor Cst', and the switching transistors T2', T3', T4', T5', T6', and T7' are connected in a like manner of the dummy pixel DPX described with reference to FIG. 5.

The switching transistor T10*d* includes a control terminal connected to an emission signal line [E(i−1)] of a previous row, a first input/output terminal connected to a node N1 between the switching transistors T6' and T7', and a second input/output terminal connected to the repair line 51*d*.

The switching transistor T8*d* includes a control terminal connected to the emission signal line Ei, a first input/output terminal connected to the repair line 51*d*, and a second input/output terminal connected to the connection node Np of the capacitor Ccp and the switching transistor T9*d*.

The switching transistor T9*d* includes a control terminal connected to a compensation signal line Ci, a first input/output terminal connected to the connection node Np, and a second input/output terminal connected to the initialization voltage line for supplying the initialization voltage Vint2.

The capacitor Ccp includes a first terminal connected to a connection node Np of the first input/output terminal of the switching transistor T9*b* and the second input/output terminal of the switching transistor T8*b*, and a second terminal connected to the initialization voltage line for supplying the initialization voltage Vint2.

The repair line 51*d* is connected to the anode of the organic light emitting element LD of the bad pixel BPX.

Referring to FIG. 17, while the emission signal Emit[i] maintains the low voltage Vgl and the previous emission signal Emit[i−1] maintains the high voltage Vgh, the initializing signal Init[i] and the compensation signal Comp[i] are switched to the low voltage Vgl. The switching transistors (T4 and T7 of FIG. 7) of the neighboring pixel PX are turned on to initialize the anode voltage Va of the organic light emitting element LD with the initialization voltage Vint.

When the switching transistors T4' and T7' are turned on at the dummy pixel DPXd, the node N1 and the repair line 51*d* are blocked by the turned-off switching transistor T10*d* so the voltage at the node N1 is initialized and the voltage Vpr of the repair line 51*d* is not initialized. Instead of this, the voltage Vrp of the repair line 51*d* is reduced by the parasitic capacitor Cap formed by the anode of the neighboring pixel PX and the repair line 51*d* according to the reduction of the anode voltage Va of the neighboring pixel PX. For example, the voltage Vrp of the repair line 51*d* may be reduced by ΔV2 volts of Equation 3. When the voltage of the compensation signal Comp[i] is reduced, the voltage Vrp of the repair line 51*d* is additionally reduced by the parasitic capacitor Csp formed by the compensation signal line Ci of the neighboring pixel PX and the repair line 51*d*. For example, the voltage Vrp of the repair line 51*d* may be reduced by ΔV1 volts of Equation 2.

The switching transistor T9*d* of the dummy pixel DPXc is turned on to initialize the capacitor Ccp with the initialization voltage Vint2, and the voltage Vp of the connection node Np is reduced to the initialization voltage Vint2.

The emission signal Emit[i] is switched to the high voltage Vgh, and the compensation signal Comp[i] and the initializing signal Init[i] increase to the high voltage Vgh from the low voltage Vgl. The voltage Vrp of the repair line 51*d* increases by the parasitic capacitor Csp according to the increase of voltage of the compensation signal Comp[i]. For example, the voltage Vrp of the repair line 51*d* may increase by ΔV1 volts of Equation 2.

The scan signal Scan[i] is switched to the low voltage Vgl and the corresponding data voltage is applied to the bad pixel BPX through the dummy signal line DL. The data voltage is assumed here to be a voltage for expressing the low gray.

The scan signal Scan[i] is switched to the high voltage Vgh, the previous emission signal Emit[i−1] is reduced to the low voltage Vgl, and the emission signal Emit[i] is reduced to the low voltage. The switching transistors T5', T6', T8*d*, T9*d*, and T10*d* of the dummy pixel DPXc are turned on and the driving transistor T1' outputs a small current corresponding to the low gray. Part of the small current output by the driving transistor T1' is used to compensate the voltage of the capacitor Ccp initialized with the initialization voltage Vint2. The charges stored in the parasitic capacitors Csp, Cap, and Cld are transmitted to the capacitor Ccp by the charge sharing between the parasitic capacitors Csp, Cap, and Cld and the capacitor Ccp to reduce the voltage Vpr of the repair line 51*d*.

The current is supplied through the driving transistor T1 on the neighboring pixel PX to increase the anode voltage Va of the organic light emitting element LD, and also increase the voltage Vrp of the repair line 51*d* by the parasitic capacitor Cap. For example, the voltage Vrp of the repair line 51*c* may be increased by ΔV2 volts of Equation 3. The voltage Vp at the connection node Np increases according to the voltage Vrp of the repair line 51*c* by the turned-on switching transistor T8*d*.

After the time T1 when the charge sharing is finished, the parasitic capacitor of the organic light emitting element LD of the bad pixel BPX and the parasitic capacitor of the repair line 51*d* are charged by the partial current output by the driving transistor T1' of the dummy pixel DPXd, and the voltage Vrp of the repair line 51*d* increases by the voltage corresponding to the low gray.

Part of the current output by the driving transistor T1' of the dummy pixel DPXd is used to compensate the voltage reduced by the charge sharing of the capacitor Ccp and the parasitic capacitor, so the bad pixel BPX may normally express the low gray or the black gray.

Figure 18:
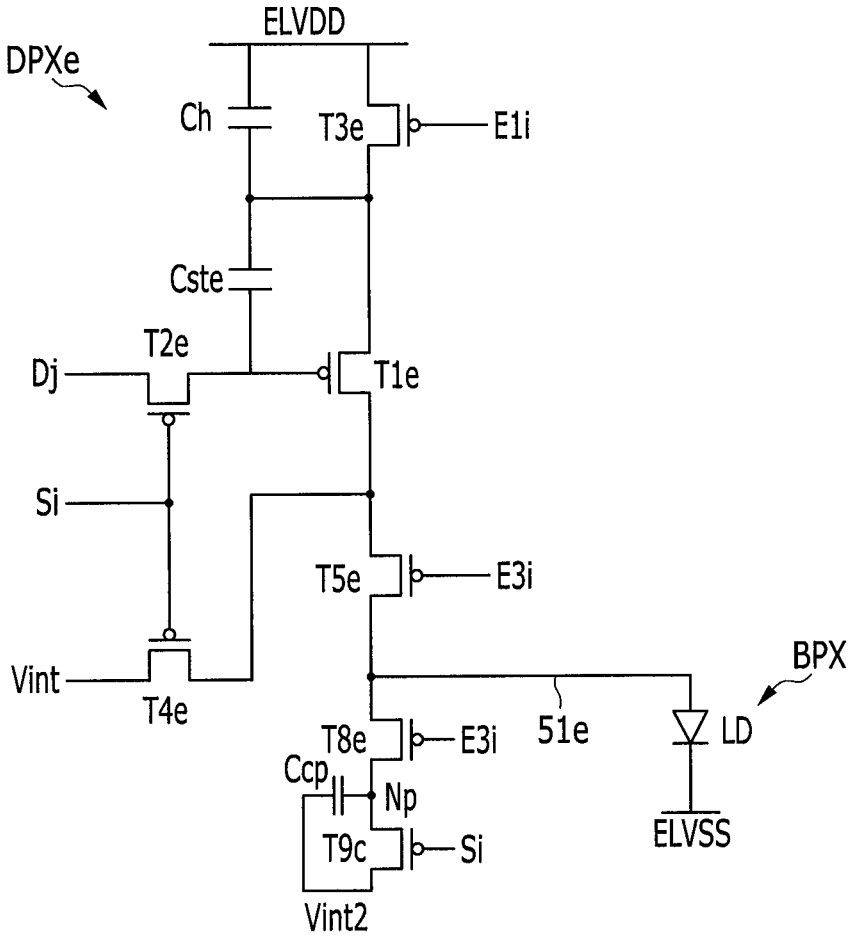
FIG. 18 shows a dummy pixel in an organic light emitting device according to yet another embodiment.
Figure 19:
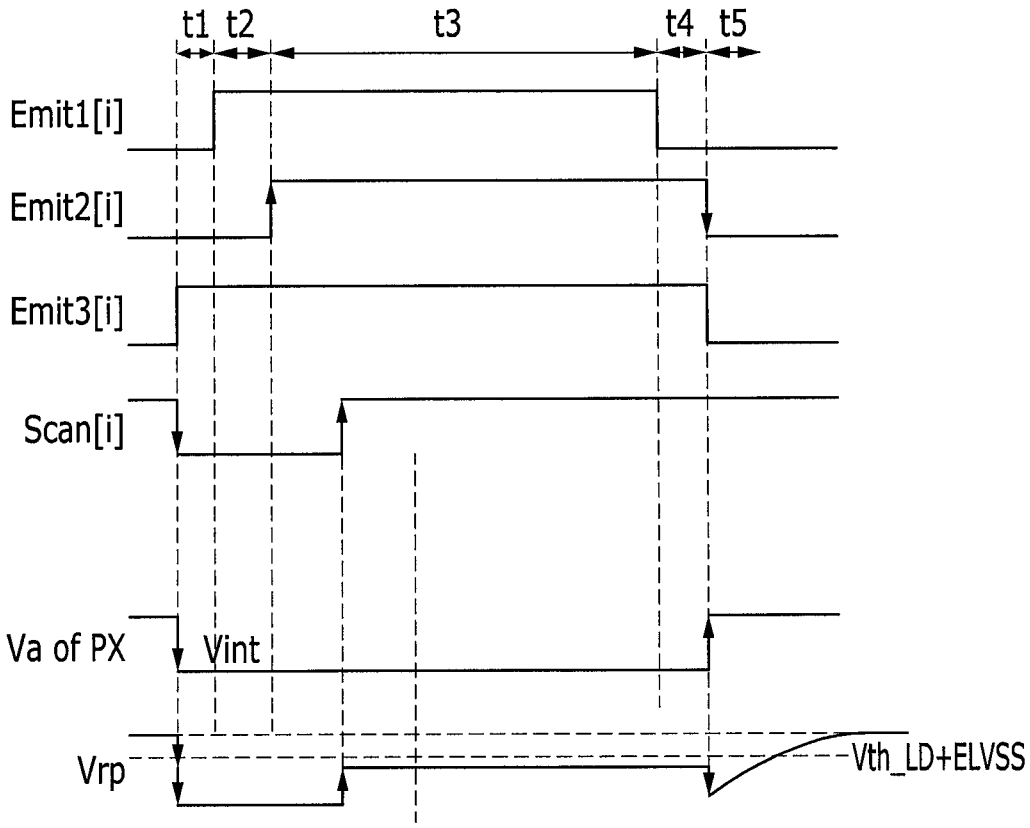
FIG. 19 shows a signal timing of an organic light emitting device shown in FIG. 18.

FIG. 18 shows a dummy pixel in an organic light emitting device according to yet another embodiment and FIG. 19 shows a signal timing of an organic light emitting device shown in FIG. 18.

Referring to FIG. 18, the dummy pixel DPXd includes a driving transistor T1*e*, capacitors Cste and Ch, switching transistors T2*e*, T3*e*, T4*e*, T5*e*, T8*e*, and T9*e*, and a capacitor Ccp.

The switching transistor T2*e* includes a control terminal connected to the scan line Si, a first input/output terminal connected to the data line Dj, and a second input/output terminal connected to the control terminal of the driving transistor T1*e*. The switching transistor T2*e* transmits the data voltage applied to the data line Dj in response to the low-voltage Vgl scan signal applied to the scan line Si.

The capacitor Cste is connected between the control terminal of the driving transistor T1*e* and the first input/output terminal, and the capacitor Ch is connected between the first input/output terminal of the driving transistor T1*e* and the driving voltage line for transmitting the driving voltage ELVDD. That is, the capacitors Ch and Cste are coupled in series between the driving voltage line and the control terminal of the driving transistor T1*e*, and stores the data voltage transmitted when the switching transistor T2*e* is turned on.

The switching transistor T3*e* includes a control terminal connected to the first emission signal line E1*i* for transmitting a first emission signal, a first input/output terminal connected to the driving voltage line ELVDD, and a second input/output terminal connected to the first input/output terminal of the driving transistor T1*e*. The switching transistor T3*e* is turned on in response to the low-voltage first emission signal to transmit the driving voltage ELVDD to the driving transistor T1*e*.

The switching transistor T4*e* includes a control terminal connected to the scan line Si, a first input/output terminal connected to the initializing signal line for transmitting the initialization voltage Vint, and a second input/output terminal connected to the second input/output terminal of the driving transistor T1*e*. The switching transistor T5*e* is turned on in response to the low-voltage scan signal to initialize the voltage at the node connected to the second input/output terminal of the driving transistor T1*e* with the initialization voltage Vint.

The switching transistor T5*e* includes a control terminal connected to the third emission signal line E3*i* for transmitting a third emission signal, and a first input/output terminal connected to the second input/output terminal of the driving transistor T1*e*. The switching transistor T5*e* is turned on in response to the low-voltage second emission signal to transmit the current output by the driving transistor T1*e*.

On the dummy pixel DPXe, the second input/output terminal of the switching transistor T5*e* is connected to the repair line 51*e* for repairing the bad pixel BPX.

The switching transistor T8*d* includes a control terminal connected to the third emission signal line E3*i* for transmitting the third emission signal, a first input/output terminal connected to the repair line 51*e*, and a second input/output terminal connected to the connection node Np of the capacitor Ccp and the switching transistor T9*e*.

The switching transistor T9*e* includes a control terminal connected to the scan line Si, a first input/output terminal connected to the connection node Np, and a second input/output terminal connected to the initialization voltage line for supplying the initialization voltage Vint2.

The capacitor Ccp includes a first terminal connected to the connection node Np of the first input/output terminal of the switching transistor T9*b* and the second input/output terminal of the switching transistor T8*b*, and a second terminal connected to the initialization voltage line for supplying the initialization voltage Vint2.

The pixel PX includes a driving transistor T1*e*, capacitors Cste and Ch, switching transistors T2*e*, T3*e*, T4*e*, and T5*e*, and an organic light emitting element LD. A connection relationship among the driving transistor T1*e*, the capacitors Cste and Ch, and the switching transistors T2*e*, T3*e*, T4*e*, and T5*e* of the pixel PX substantially corresponds to the connection relationship among the driving transistor T1*e*, the capacitors Cste and Ch, and the switching transistors T2*e*, T3*e*, T4*e*, and T5*e* of the dummy pixel DPXe. The switching transistor T5*e* of the pixel PX includes a control terminal connected to the second emission signal line for transmitting the second emission signal, and a second input/output terminal connected to the anode of the organic light emitting element LD.

Referring to FIG. 19, during a period t1, the scan signal Scan[i] is switched to the low voltage Vgl while the first emission signal Emit1[*i*] transmitted to the first emission signal line E1*i* and the second emission signal Emit2[*i*] transmitted to the second emission signal line E2*i* maintain the low voltage Vgl. The switching transistors T3*e*, T5*e*, and T4*e* of the neighboring pixel PX in the same row as the bad pixel BPX are turned on to initialize the anode voltage Va of the organic light emitting element LD with the initialization voltage Vint.

The switching transistor T5*e* of the dummy pixel DPXe is turned off by the high-voltage Vgh third emission signal line E3*i* so the voltage Vpr of the repair line 51*e* is not initialized. Instead of this, the voltage Vrp of the repair line 51*e* is reduced by the parasitic capacitor Cap formed by the anode of the neighboring pixel PX and the repair line 51*e* according to the reduction of the anode voltage Va of the neighboring pixel PX. For example, the voltage Vrp of the repair line 51*e* may be reduced by ΔV2 volts of Equation 3. When the voltage of the scan signal Scan[i] is reduced, the voltage Vrp of the repair line 51*e* is additionally reduced by the parasitic capacitor Csp formed by the scan line Si of the neighboring pixel PX and the repair line 51*e*. For example, the voltage Vrp of the repair line 51*e* may be reduced by ΔV1 volts of Equation 2.

The switching transistor T9*e* of the dummy pixel DPXe is turned on by the low-voltage Vgl scan signal Scan[i] to initialize the capacitor Ccp with the initialization voltage Vint2.

During a period t2, the first emission signal Emit1[*i*] is switched to the high voltage Vgh to turn off the switching transistor T3*e*. The current flows to the initialization voltage Vint from the capacitor Cste through the driving transistor T1*e* and the switching transistor T4*e* so the voltage corresponding to the threshold voltage of the driving transistor T1*e* is charged in the capacitor Cste.

During a period t3, the second emission signal Emit2[*i*] is switched to the high voltage Vgh and the data voltage is transmitted to the dummy signal line DL. The data voltage is assumed here to be a voltage for expressing the low gray. The data voltage to which the threshold voltage of the driving transistor T1*e* is reflected is stored in the capacitors Cste and Ch. The scan signal Scan[i] increases from the low voltage Vgl to the high voltage Vgh. The voltage Vrp of the repair line 51*e* increases by the parasitic capacitor Csp according to the increase of voltage of the scan signal Scan[i]. For example, the voltage Vrp of the repair line 51*e* may increase by ΔV1 volts of Equation 2.

During a period t4, the first emission signal Emit1[*i*] is reduced to the low voltage Vgl to turn on the switching transistor T3*e*.

During a period t5, the second emission signal Emit2[*i*] and the third emission signal Emit3[*i*] are reduced to the low voltage Vgl to turn on the switching transistor T5*e* of the neighboring pixel PX and the switching transistors T5*e* and T8*e* of the dummy pixel DPXe. The driving transistor T1' of the dummy pixel DPXe outputs a small current corresponding to the low gray, and part of the small current is used to compensate the voltage of the capacitor Ccp initialized with the initialization voltage Vint2. The charges stored in the parasitic capacitors Csp, Cap, and Cld are transmitted to the capacitor Ccp by the charge sharing between the parasitic capacitors Csp, Cap, and Cld and the capacitor Ccp to reduce the voltage Vpr of the repair line 51*e*.

The current is supplied through the driving transistor T1 on the neighboring pixel PX to increase the anode voltage Va of the organic light emitting element LD, and also increase the voltage Vrp of the repair line 51*e* by the parasitic capacitor Cap. For example, the voltage Vrp of the repair line 51*e* may be increased by ΔV2 volts of Equation 3. After the time when the charge sharing is finished, the voltage Vrp of the repair line 51*e* increases by the voltage corresponding to the low gray.

Part of the current output by the driving transistor T1*e* of the dummy pixel DPXe is used to compensate the voltage reduced by the charge sharing of the capacitor Ccp and the parasitic capacitor, so the bad pixel BPX may normally express the low gray or the black gray.

In an embodiment, regarding FIG. 18 and FIG. 19, the first emission signal Emit1[*i*] may be used as the third emission signal Emit3[*i*].

Figure 20:
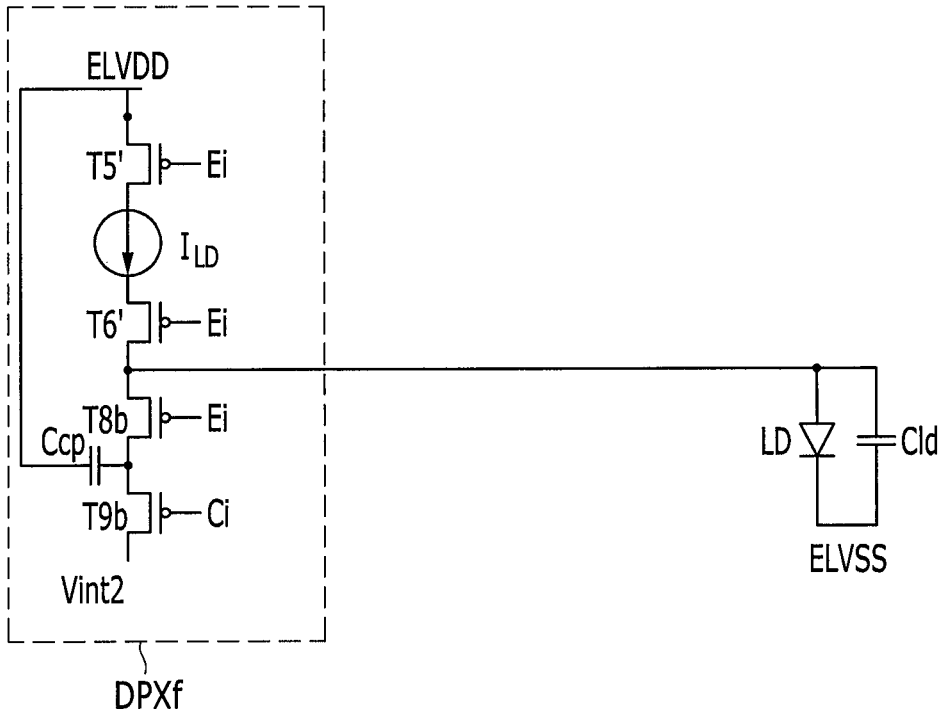
FIG. 20, FIG. 21, and FIG. 22 show repairing of a bad pixel in an organic light emitting device according to yet another embodiment.
Figure 21:
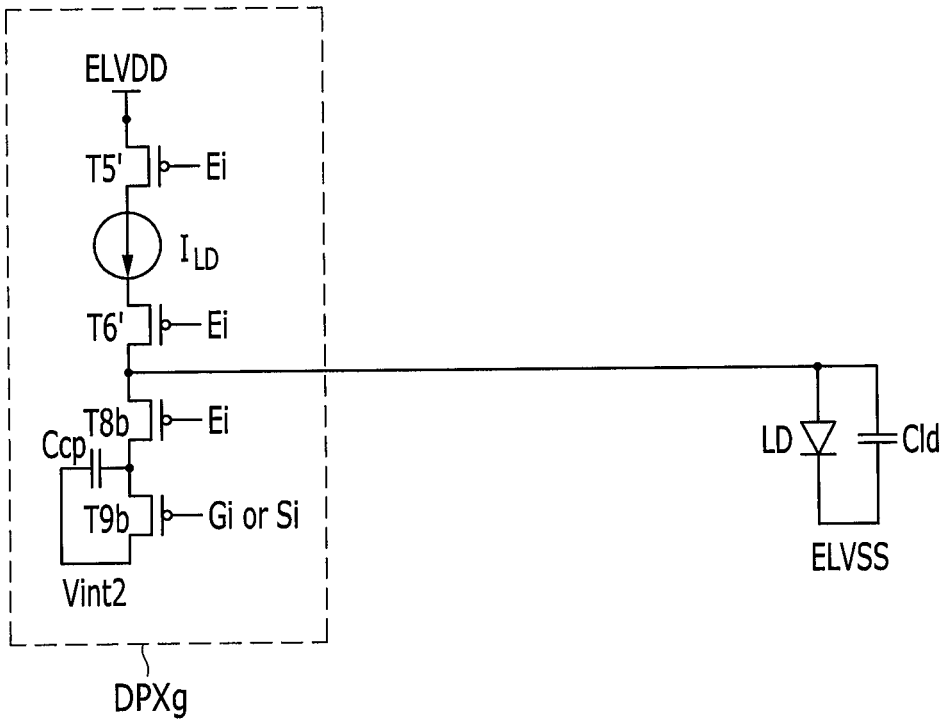
Figure 22:
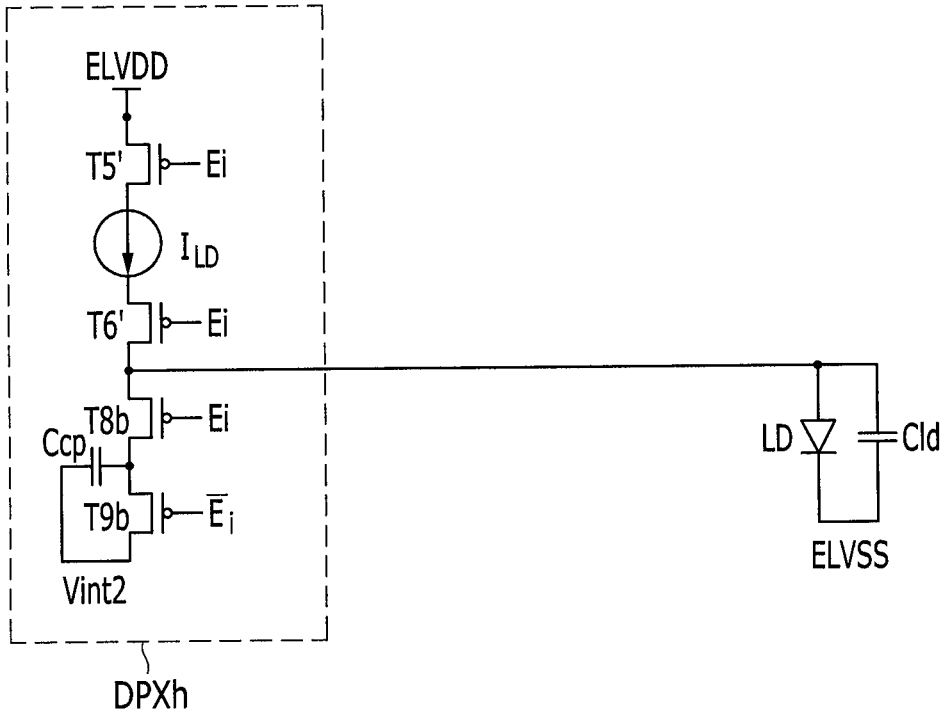

FIG. 20, FIG. 21, and FIG. 22 show repairing of a bad pixel in an organic light emitting device according to yet another embodiment.

In an embodiment, the first terminal of the capacitor Ccp of the dummy pixel DPXf may be connected to a signal line for transmitting a different voltage rather than the initializing signal line for transmitting the initialization voltage Vint2. In an embodiment, as shown in FIG. 20, the first terminal of the capacitor Ccp may be connect to the driving voltage line for transmitting the driving voltage ELVDD.

In an embodiment, the control terminal of the switching transistor T9*b* for initializing the capacitor Ccp of the dummy pixel DPXf may be connected to another signal line. In an embodiment, as shown in FIG. 21, the control terminal of the switching transistor T9*b* may be connected to the initializing signal line Gi for transmitting the initializing signal Init[i] or the scan line Si for transmitting the scan signal Scan[i]. In another embodiment, as shown in FIG. 22, the control terminal of the switching transistor T9*b* may be connected to an inverted emission scan line ($\overline{E}_i$) for transmitting an inverted signal of the emission signal Emit[i].

While this disclosure has been described in connection with what is presently considered to be practical embodiments, it is to be understood that the invention is not limited to the disclosed embodiments, but, on the contrary, is intended to cover various suitable modifications and equivalent arrangements included within the spirit and scope of the appended claims and their equivalents.

What is claimed is:

1. An organic light emitting device comprising:

a repair line connected to an organic light emitting element of a bad pixel;

a first capacitor configured to store a voltage corresponding to a data voltage of the bad pixel;

a driving transistor configured to output a current corresponding to the voltage stored in the first capacitor to an output terminal;

a first transistor connected between the output terminal of the driving transistor and the repair line, and configured to be turned on or turned off in response to a first signal;

a second transistor connected between the repair line and a node, and configured to be turned on or turned off in response to a second signal;

a third transistor connected between the node and a first voltage line for supplying a first voltage, and configured to be turned on or turned off in response to a third signal; and a second capacitor connected between the node and a second voltage line for supplying a second voltage.

2. The organic light emitting device of claim 1, wherein while the first transistor and the second transistor are turned off, a voltage of the third signal is changed from a first level to a second level to turn on the third transistor.

3. The organic light emitting device of claim 2, wherein after the voltage of the third signal is changed to the first level from the second level to turn off the third transistor, the first transistor and the second transistor are turned on.

4. The organic light emitting device of claim 3, wherein the first signal is the same as the second signal.

5. The organic light emitting device of claim 1, wherein while the first transistor is turned off and the second transistor is turned on, the voltage of the third signal is changed to a second level from a first level to turn on the third transistor.

6. The organic light emitting device of claim 5, wherein after the second transistor is turned off, the voltage of the third signal is changed to the first level from the second level to turn off the third transistor.

7. The organic light emitting device of claim 6,
wherein after the third transistor is turned off, the first transistor and the second transistor are turned on.

8. The organic light emitting device of claim 1,
wherein the first voltage is the same as the second voltage.

9. The organic light emitting device of claim 1,
wherein the second voltage is the same as a driving voltage transmitted to the driving transistor.

10. The organic light emitting device of claim 1,
wherein the third signal is an inverted signal of the second signal.

11. The organic light emitting device of claim 1, further comprising:
a fourth transistor configured to transmit the data voltage when turned on in response to a scan signal,
wherein the third signal is the same as the scan signal.

12. The organic light emitting device of claim 1, further comprising:
a fourth transistor configured to be turned on in response to a fourth signal to initialize a voltage of the capacitor with an initialization voltage,
wherein the first voltage is the same as the initialization voltage.

13. The organic light emitting device of claim 12,
wherein the third signal is the same as the fourth signal.

14. An organic light emitting device comprising:
a repair line connected to an organic light emitting element of a bad pixel; and
a dummy pixel connected to the repair line,
wherein the dummy pixel comprises:
a dummy pixel driving circuit configured to output a driving current corresponding to a data voltage of the bad pixel to the repair line in response to a first signal, and
a capacitor configured to be initialized before the driving current is output by the dummy pixel driving circuit and to be charged by the driving current and to perform a charge sharing with a parasitic capacitance component of the repair line when the dummy pixel driving circuit outputs the driving current.

15. The organic light emitting device of claim 14,
wherein the dummy pixel further comprises a transistor connected between the capacitor and the repair line, the transistor being configured to be turned on or turned off in response to the first signal.

16. The organic light emitting device of claim 14,
wherein the dummy pixel further comprises a transistor connected between the capacitor and a voltage line for supplying an initialization voltage, the transistor being configured to be turned on or turned off in response to a second signal.

17. The organic light emitting device of claim 16,
wherein before the dummy pixel driving circuit outputs the driving current to the repair line, the voltage of the second signal is changed to a second level from a first level to turn on the transistor.

18. The organic light emitting device of claim 17,
wherein after the voltage of the second signal is changed to the first level from the second level to turn on the transistor, the dummy pixel driving circuit outputs the driving current to the repair line.

19. A method of repair an organic light emitting device comprising:
connecting a repair line to an organic light emitting element of a bad pixel;
initializing a capacitor;
outputting a driving current corresponding to a data voltage of the bad pixel to the repair line;
while outputting the driving current to the repair line, charging the capacitor with the driving current; and
while outputting the driving current to the repair line, performing charge sharing between the capacitor and a parasitic capacitance component of the repair line.

20. The method of claim 19, further comprising:
allowing the organic light emitting element of the bad pixel to emit light with the driving current.

* * * * *